US011012773B2

(12) United States Patent
Bezzola

(10) Patent No.: US 11,012,773 B2
(45) Date of Patent: May 18, 2021

(54) WAVEGUIDE FOR SMOOTH OFF-AXIS FREQUENCY RESPONSE

(71) Applicant: Samsung Electronics Co., Ltd., Suwon-si (KR)

(72) Inventor: Andri Bezzola, Pasadena, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/457,619

(22) Filed: Jun. 28, 2019

(65) Prior Publication Data

US 2020/0077180 A1 Mar. 5, 2020

Related U.S. Application Data

(60) Provisional application No. 62/726,814, filed on Sep. 4, 2018.

(51) Int. Cl.
*H04R 1/34* (2006.01)

(52) U.S. Cl.
CPC ..... *H04R 1/345* (2013.01)

(58) Field of Classification Search
CPC ..... H04R 1/30; H04R 1/345; G10K 11/02; G10K 11/025
See application file for complete search history.

(56) References Cited

U.S. PATENT DOCUMENTS 4,157,741 A * 6/1979 Goldwater ..... H04R 1/30 181/156
4,381,831 A * 5/1983 Putnam ..... G10K 11/025 181/152
4,580,655 A * 4/1986 Keele, Jr. ..... H04R 1/345 181/192
5,600,718 A 2/1997 Dent et al.
5,870,484 A 2/1999 Greenberger et al.
6,028,947 A * 2/2000 Faraone ..... H04R 1/30 381/340
6,059,926 A 5/2000 Hiroshima
(Continued)

FOREIGN PATENT DOCUMENTS

CN 107872759 A 4/2018
EP 0548836 B1 11/1997
(Continued)

OTHER PUBLICATIONS

Henwood, "The Boundary-Element Method and Horn Design", J. Audio Eng. Soc., vol. 41, No. 6, Jun. 1993, pp. 485-496 (Year: 1993).*
(Continued)

*Primary Examiner* — Ryan Robinson
(74) *Attorney, Agent, or Firm* — Sherman IP LLP; Kenneth L. Sherman; Hemavathy Perumal

(57) ABSTRACT

One embodiment provides a waveguide for controlling sound directivity of high frequency sound waves generated by a speaker driver. The waveguide is positioned in front of the speaker driver. The waveguide comprises one or more ridge areas, one or more recess areas, and one or more smooth surfaces. Each smooth surface connects a ridge area to a recess area to create a smooth transition between the ridge area and the recess area without any seams or sharp transitions. The waveguide shapes propagation of the sound waves to provide a smooth off-axis frequency response for the sound waves.

20 Claims, 16 Drawing Sheets

(56) References Cited

U.S. PATENT DOCUMENTS

| | | | | |
|---|---|---|---|---|
| 6,275,592 | B1 | 8/2001 | Vartiainen | |
| 7,013,011 | B1 | 3/2006 | Weeks et al. | |
| 7,024,014 | B1 | 4/2006 | Noll | |
| 7,197,443 | B2 * | 3/2007 | Manrique | H04R 7/12 381/340 |
| 7,348,908 | B2 | 3/2008 | Slavin | |
| 7,359,519 | B2 | 4/2008 | Lee et al. | |
| 7,372,966 | B2 | 5/2008 | Bright | |
| 7,467,071 | B2 | 12/2008 | Manrique | |
| 7,477,751 | B2 | 1/2009 | Lyon et al. | |
| 7,686,129 | B2 * | 3/2010 | Delgado, Jr. | H04R 1/30 181/148 |
| 7,688,984 | B2 | 3/2010 | De Callafon | |
| 8,073,149 | B2 | 12/2011 | Kuze | |
| 8,086,956 | B2 | 12/2011 | Su et al. | |
| 8,130,994 | B2 | 3/2012 | Button et al. | |
| 8,146,989 | B2 | 4/2012 | Godiska et al. | |
| 8,204,210 | B2 | 6/2012 | van de Laar et al. | |
| 8,300,837 | B2 | 10/2012 | Shmunk | |
| 8,391,498 | B2 | 3/2013 | Potard | |
| 8,538,040 | B2 | 9/2013 | Kirn | |
| 8,548,184 | B2 * | 10/2013 | Werner | H04R 1/345 181/177 |
| 8,577,047 | B2 | 11/2013 | Gautama | |
| 8,712,065 | B2 | 4/2014 | Solgaard et al. | |
| 8,855,322 | B2 | 10/2014 | Ryu et al. | |
| 8,938,084 | B2 | 1/2015 | Arai | |
| 9,042,561 | B2 | 5/2015 | Gautama et al. | |
| 9,130,527 | B2 | 9/2015 | Potard | |
| 9,154,101 | B2 | 10/2015 | Dhuyvetter | |
| 9,161,126 | B2 | 10/2015 | Su et al. | |
| 9,374,634 | B2 | 6/2016 | Macours et al. | |
| 9,432,771 | B2 | 8/2016 | Oyetunji et al. | |
| 9,553,554 | B2 | 1/2017 | Kimura et al. | |
| 9,578,416 | B2 | 2/2017 | Gautama et al. | |
| 9,635,454 | B2 | 4/2017 | Larrien M | |
| 9,661,428 | B2 | 5/2017 | Holladay et al. | |
| 9,693,148 | B1 | 6/2017 | Lopez et al. | |
| 9,813,812 | B2 | 11/2017 | Berthelsen et al. | |
| 9,837,971 | B2 | 12/2017 | Luo et al. | |
| 9,883,305 | B2 | 1/2018 | Risberg et al. | |
| 9,900,690 | B2 | 2/2018 | Risberg et al. | |
| 9,924,249 | B2 * | 3/2018 | Sprinkle | H04R 1/30 |
| 9,967,652 | B2 | 5/2018 | Baird et al. | |
| 9,980,068 | B2 | 5/2018 | Berthelsen et al. | |
| 9,992,571 | B2 | 6/2018 | Hu | |
| 10,219,090 | B2 | 2/2019 | Adams et al. | |
| 10,382,860 | B2 * | 8/2019 | Spillmann | H04R 1/345 |
| 10,542,361 | B1 | 1/2020 | Lazar et al. | |
| 2002/0141098 | A1 | 10/2002 | Schlager | |
| 2003/0076875 | A1 | 4/2003 | Oates | |
| 2003/0076975 | A1 | 4/2003 | Stead et al. | |
| 2004/0028242 | A1 | 2/2004 | Kitamura | |
| 2005/0122166 | A1 | 6/2005 | Premakanthan et al. | |
| 2006/0274904 | A1 | 12/2006 | Lashkari | |
| 2007/0098190 | A1 | 5/2007 | Song et al. | |
| 2008/0175397 | A1 | 7/2008 | Holman et al. | |
| 2009/0180636 | A1 | 7/2009 | Su et al. | |
| 2010/0092004 | A1 | 4/2010 | Kuze | |
| 2012/0203526 | A1 | 8/2012 | Bai et al. | |
| 2012/0288118 | A1 | 11/2012 | Gautama et al. | |
| 2012/0289809 | A1 | 11/2012 | Kaib et al. | |
| 2013/0094657 | A1 | 4/2013 | Brammer et al. | |
| 2014/0051483 | A1 | 2/2014 | Schoerkmaier | |
| 2014/0254827 | A1 | 9/2014 | Bailey et al. | |
| 2014/0286500 | A1 | 9/2014 | Iwamoto et al. | |
| 2015/0010168 | A1 | 1/2015 | Cheng et al. | |
| 2015/0010171 | A1 | 1/2015 | Pernici et al. | |
| 2015/0208175 | A1 | 7/2015 | Pinkerton et al. | |
| 2015/0281844 | A1 | 10/2015 | Stabile | |
| 2015/0319529 | A1 | 11/2015 | Klippel et al. | |
| 2016/0134982 | A1 | 5/2016 | Iyer | |
| 2016/0360331 | A1 | 12/2016 | Yeh | |
| 2016/0366515 | A1 | 12/2016 | Mendes et al. | |
| 2016/0373858 | A1 | 12/2016 | Lawrence et al. | |
| 2017/0055067 | A1 | 2/2017 | Moro et al. | |
| 2017/0188150 | A1 | 6/2017 | Brunet et al. | |
| 2017/0272045 | A1 | 9/2017 | Chadha | |
| 2017/0280240 | A1 | 9/2017 | Hu | |
| 2017/0318388 | A1 | 11/2017 | Risberg et al. | |
| 2017/0325019 | A1 * | 11/2017 | Bezzola | H04R 1/26 |
| 2017/0345438 | A1 | 11/2017 | Thyssen | |
| 2018/0014120 | A1 | 1/2018 | Lawrence et al. | |
| 2018/0034430 | A1 | 2/2018 | Ahmed et al. | |
| 2018/0054671 | A1 * | 2/2018 | Voishvillo | H04R 9/066 |
| 2018/0192192 | A1 | 7/2018 | Brunet et al. | |
| 2018/0206049 | A1 | 7/2018 | Wendell et al. | |
| 2019/0222939 | A1 | 7/2019 | Brunet et al. | |
| 2019/0281385 | A1 | 9/2019 | Brunet et al. | |
| 2020/0083853 | A1 | 3/2020 | Brunet et al. | |

FOREIGN PATENT DOCUMENTS

| | | | |
|---|---|---|---|
| EP | 1799013 | B1 | 2/2010 |
| EP | 2369852 | A1 | 9/2011 |
| EP | 2642769 | A1 | 9/2013 |
| EP | 3079375 | A1 | 10/2016 |
| JP | 3433342 | B2 | 8/2003 |
| JP | 2004312141 | A | 11/2004 |
| JP | 2005129977 | A | 5/2005 |
| JP | 2007060648 | A | 3/2007 |
| JP | 2007081815 | A | 3/2007 |
| JP | 2015082754 | A | 4/2015 |
| JP | 2015084499 | A | 4/2015 |
| JP | 6182869 | B2 | 8/2017 |
| KR | 10-20050023841 | A | 3/2005 |
| KR | 10-20130001162 | | 1/2013 |
| KR | 10-20140097874 | A | 8/2014 |
| KR | 101445186 | B1 | 10/2014 |
| WO | 2013182901 | A | 12/2013 |
| WO | 2014045123 | A | 3/2014 |
| WO | 2015143127 | A | 9/2015 |
| WO | 2015191691 | A1 | 12/2015 |
| WO | 2017088876 | A1 | 6/2017 |

OTHER PUBLICATIONS

International Search Report dated Jun. 21, 2019 for International Application PCT/KR2019/002741 from Korean Intellectual Property Office, pp. 1-3, Republic of Korea.

U.S. Supplemental Notice of Allowability for U.S. Appl. No. 15/835,245 dated Aug. 28, 2019.

U.S. Notice of Allowability for U.S. Appl. No. 15/873,530 dated Aug. 28, 2019.

U.S. Notice of Allowability for U.S. Appl. No. 15/873,530 dated Sep. 9, 2019.

U.S. Notice of Allowance for U.S. Appl. No. 16/057,711 dated Sep. 17, 2019.

International Search Report and Written Opinion dated Dec. 23, 2019 for International Application PCT/KR2019/011591 from Korean Intellectual Property Office, pp. 1-9, Republic of Korea.

ProSoundWeb, "Harman Unveils JBL 3 Series Mk II Powered Studio Monitors," Jan. 2018, pp. 1-4, EH Publishing, United States, downloaded at: https://www.prosoundweb.com/channels/recording/harman-unveils-jbl-3-series-mkii-powered-studio-monitors/.

European Office Action dated Nov. 15, 2019 for European Application No. 16882101.5 from European Patent Office, pp. 1-6, Munich, Germany.

Chinese Office Action dated Dec. 5, 2019 for Chinese Patent Application No. 201680076647.X from Chinese Patent Office, pp. 1-21, Beijing, China (English-language translation included pp. 1-14).

Extended European Search Report dated Nov. 21, 2019 for European Application No. 18736189.4 from European Patent Office, pp. 1-7, Munich, Germany.

Schurer, H. et al., "Theoretical and experimental comparison of three methods for compensation of electrodynamic transducer nonlinearity.", Journal of the Audio Engineering Society, Sep. 1, 1998, vol. 46, No. 9, pp. 723-740, The Netherlands.

(56) References Cited

OTHER PUBLICATIONS

International Search Report and Written Opinion dated Dec. 23, 2019 for International Application PCT/KR2019/011200 from Korean Intellectual Property Office, pp. 1-12, Republic of Korea.
U.S. Notice of Allowance for U.S. Appl. No. 15/391,633 dated Sep. 18, 2019.
U.S. Supplemental Notice of Allowability for U.S. Appl. No. 15/835,245 dated Oct. 1, 2019.
U.S. Corrected Notice of Allowability for U.S. Appl. No. 15/873,530 dated Oct. 18, 2019.
U.S. Corrected Notice of Allowability for U.S. Appl. No. 15/873,530 dated Nov. 12, 2019.
U.S. Non-Final Office Action for U.S. Appl. No. 16/224,604 dated Oct. 22, 2019.
U.S. Corrected Notice of Allowability for U.S. Appl. No. 15/391,633 dated Dec. 12, 2019.
Thomsen, S. et. al., "Design and Analysis of a Flatness-Based Control Approach for Speed Control of Drive Systems with Elastic Couplings and Uncertain Loads," Proceedings of the 2011-14th European Conference (EPE 2011), Aug. 30-Sep. 1, 2011, pp. 1-10, IEEE Press, United States.
Fliess, M. et al., "Flatness and Defect of Nonlinear Systems: Introductory Theory and Examples", International Journal of Control, Jun. 1995, pp. 1327-1361, vol. 61, Taylor & Francis, United Kingdom.
Papazoglou, N. et al., "Linearisation par Asservissement d'unhaut-parleur electrodynamique: approche par les Systemes. Hamiltoniens a Ports", Memoire De Fin D Etude M2R SAR Parcourt ATIAM, pp. 1-52, Aug. 11, 2014
International Search Report and Written Opinion dated Mar. 31, 2017 for International Application PCT/KR2016/015435 from Korean Intellectual Property Office, pp. 1-12, Republic of Korea.
International Search Report and Written Opinion dated Apr. 20, 2018 for International Application PCT/KR2018/000016 from Korean Intellectual Property Office, pp. 1-5, Republic of Korea.
Extended European Search Report dated Jul. 23, 2018 for European Application No. 16882101.5 from European Patent Office, pp. 1-8, Munich, Germany.
Hu, Y. et al., "Effects of the Cone and Edge on the Acoustic Characteristics of a Cone Loudspeaker", Advances in Acoustics and Vibration, May 21, 2017, pp. 1-12, vol. 2017, Hindawi, Japan.
Salvatti, A. et al., "Maximizing performance from loudspeaker ports," Journal of the Audio Engineering Society, Jan./Feb. 2002, pp. 19-45, v. 50, No. 1/2, United States.
International Search Report and Written Opinion dated Apr. 29, 2019 for International Application PCT/KR2019/000702 from Korean Intellectual Property Office, pp. 1-10, Republic of Korea.
International Search Report and Written Opinion dated May 7, 2019 for International Application PCT/KR2019/001090 from Korean Intellectual Property Office, pp. 1-13, Republic of Korea.
U.S. Non-Final Office Action for U.S. Appl. No. 16/391,081 dated Mar. 31, 2020.
U.S. Notice of Allowance for U.S. Appl. No. 16/391,081 dated May 27, 2020.
U.S. Non-Final Office Action for U.S. Appl. No. 15/391,633 dated Mar. 28, 2019.
U.S. Non-Final Office Action for U.S. Appl. No. 15/835,245 dated Jun. 14, 2018.
U.S. Final Office Action for U.S. Appl. No. 15/835,245 dated Jan. 10, 2019.
U.S. Advisory Action for U.S. Appl. No. 15/835,245 dated Apr. 11, 2019.
U.S. Notice of Allowance for U.S. Appl. No. 15/835,245 dated May 6, 2019.
U.S. Supplemental Notice of Allowability for U.S. Appl. No. 15/835,245 dated Jul. 15, 2019.
U.S. Notice of Allowance for U.S. Appl. No. 15/873,530 dated Jul. 18, 2019.
U.S. Notice of Allowance for U.S. Appl. No. 16/057,711 dated Apr. 2, 2019.
U.S. Notice of Allowance for U.S. Appl. No. 16/224,604 dated Feb. 13, 2020.

* cited by examiner

55

100

410

400

470

470

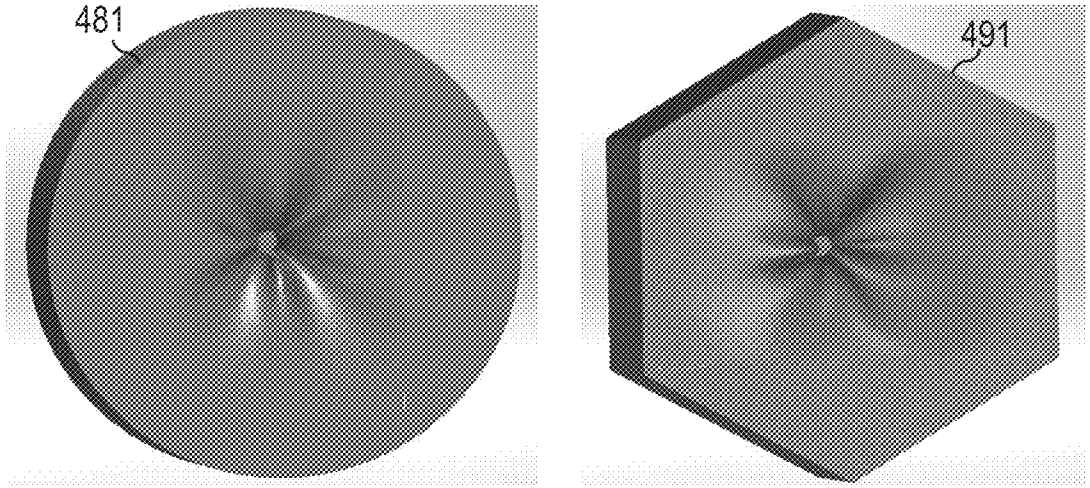
FIG. 11A
FIG. 11B
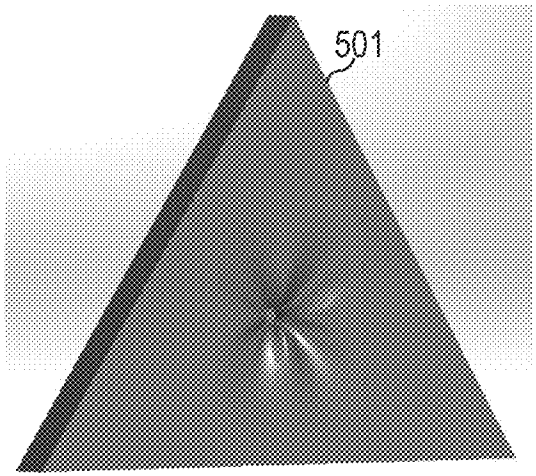
FIG. 11C

WAVEGUIDE FOR SMOOTH OFF-AXIS FREQUENCY RESPONSE

CROSS-REFERENCE TO RELATED APPLICATIONS

The present application claims priority to U.S. Provisional Patent Application No. 62/726,814, filed on Sep. 4, 2018, hereby incorporated by reference in its entirety.

TECHNICAL FIELD

One or more embodiments relate generally to loudspeakers, and in particular, to a waveguide for smooth off-axis frequency response.

BACKGROUND

A loudspeaker reproduces audio when connected to a receiver (e.g., a stereo receiver, a surround receiver, etc.), a television (TV) set, a radio, a music player, an electronic sound producing device (e.g., a smartphone), video players, etc. A loudspeaker typically distributes low frequency sound waves in all directions, whereas the loudspeaker typically focuses high frequency (e.g., 2 kiloHertz (kHz) to 20 kHz) sound waves to a narrow beam.

SUMMARY

One embodiment provides a waveguide for controlling sound directivity of high frequency sound waves generated by a speaker driver. The waveguide is positioned in front of the speaker driver. The waveguide comprises one or more ridge areas, one or more recess areas, and one or more smooth surfaces. Each smooth surface connects a ridge area to a recess area to create a smooth transition between the ridge area and the recess area without any seams or sharp transitions. The waveguide shapes propagation of the sound waves to provide a smooth off-axis frequency response for the sound waves.

These and other features, aspects and advantages of the one or more embodiments will become understood with reference to the following description, appended claims and accompanying figures.

BRIEF DESCRIPTION OF THE DRAWINGS

FIG. 11A illustrates another example waveguide with a circular outer perimeter, in accordance with one embodiment;

FIG. 11B illustrates another example waveguide with a hexagonal outer perimeter, in accordance with one embodiment;

FIG. 11C illustrates another example waveguide with a triangular outer perimeter, in accordance with one embodiment;

DETAILED DESCRIPTION

Figure 1:
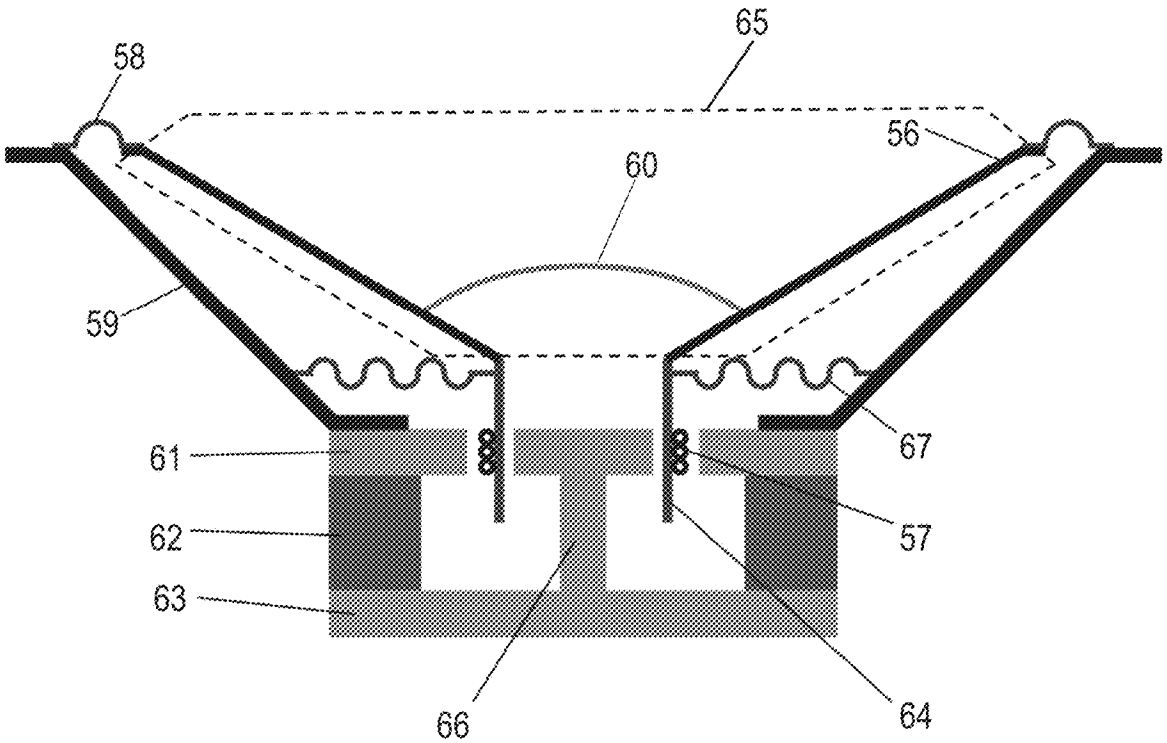
FIG. 1 illustrates a cross sectional view of an example speaker driver.

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments relate generally to loudspeakers, and in particular, to a waveguide for smooth off-axis frequency response. One embodiment provides a waveguide for controlling sound directivity of high frequency sound waves generated by a speaker driver. The waveguide is positioned in front of the speaker driver. The waveguide comprises one or more ridge areas, one or more recess areas, and one or more smooth surfaces. Each smooth surface connects a ridge area to a recess area to create a smooth transition between the ridge area and the recess area without any seams or sharp transitions. The waveguide shapes propagation of the sound waves to provide a smooth off-axis frequency response for the sound waves.

For expository purposes, the terms "loudspeaker", "loudspeaker device", and "loudspeaker system" may be used interchangeably in this specification.

For expository purposes, the term "listening position" as used in this specification generally refers to a position of a listener relative to a loudspeaker device.

To reproduce audio that sounds good at an intended listening position, a loudspeaker should have a flat frequency response at this position. This may be achieved via digital signal processing (DSP) techniques, such equalization (EQ). A loudspeaker typically focuses high frequency sound waves to a narrow beam in a direction perpendicular to a diaphragm of a speaker driver of the loudspeaker. As a result, it is not possible to achieve a flat frequency response at off-axis points (i.e., listening positions that are not an intended listening position) as sound energy drops with higher frequencies as a listener moves away from a sweet spot. A loudspeaker, however, can still be perceived as a good loudspeaker at these off-axis points if a frequency response at these points drops smoothly and monotonously with increasing frequencies; such a frequency response cannot be attained via DSP, while simultaneously maintaining a flat frequency response at the on-axis position (i.e., the intended listening position).

Sound reproduced from a loudspeaker in a room can reflect off walls, a ceiling, and a floor of the room. For example, if the loudspeaker is in a room with four walls, a flat ceiling, and a flat floor, horizontal and vertical planes contain sound that can reach a listener with just one reflection. Sound reflecting off walls at oblique angles is likely to need more than one reflection to reach a listener, and is therefore less important than sound in horizontal and vertical planes.

A loudspeaker device includes at least one speaker driver for reproducing sound. FIG. 1 illustrates a cross sectional view of an example speaker driver 55. The speaker driver 55 comprises one or more moving components, such as a driver voice coil 57, a former 64, and a diaphragm 65 (e.g., a cone-shaped diaphragm) including one or more cone parts 56 and/or a protective dust cap 60 (e.g., a dome-shaped dust cap). The speaker driver 55 further comprises one or more of the following components: (1) a surround roll 58 (e.g., suspension roll), (2) a basket 59, (3) a top plate 61, (4) a magnet 62, (5) a bottom plate 63, (6) a pole piece 66, and (7) a spider 67.

The speaker driver 55 is one of a low-frequency speaker driver, a mid-frequency (200 Hertz (Hz) to 2 kiloHertz (kHz)) speaker driver, or a high-frequency (e.g., 2 kHz to 20 kHz) speaker driver.

The diaphragm 65 transfers an electrical signal received from an amplifier (e.g., an applied voltage from a voltage source amplifier) for driving the speaker driver 55 into an acoustic signal. Displacement/excursion of the diaphragm 65 creates sound waves.

The diaphragm 65 may include ridge areas and recess areas to add mechanical stiffness to the diaphragm 65. Such ridge areas and recess areas, however, do not control beamwidth or provide smooth off-axis frequency response as the ridge area and recess areas are typically too small (i.e., has very small dimensions/size) to be able to direct sound spatially (i.e., cannot operate as acoustic waveguides).

Figure 2:
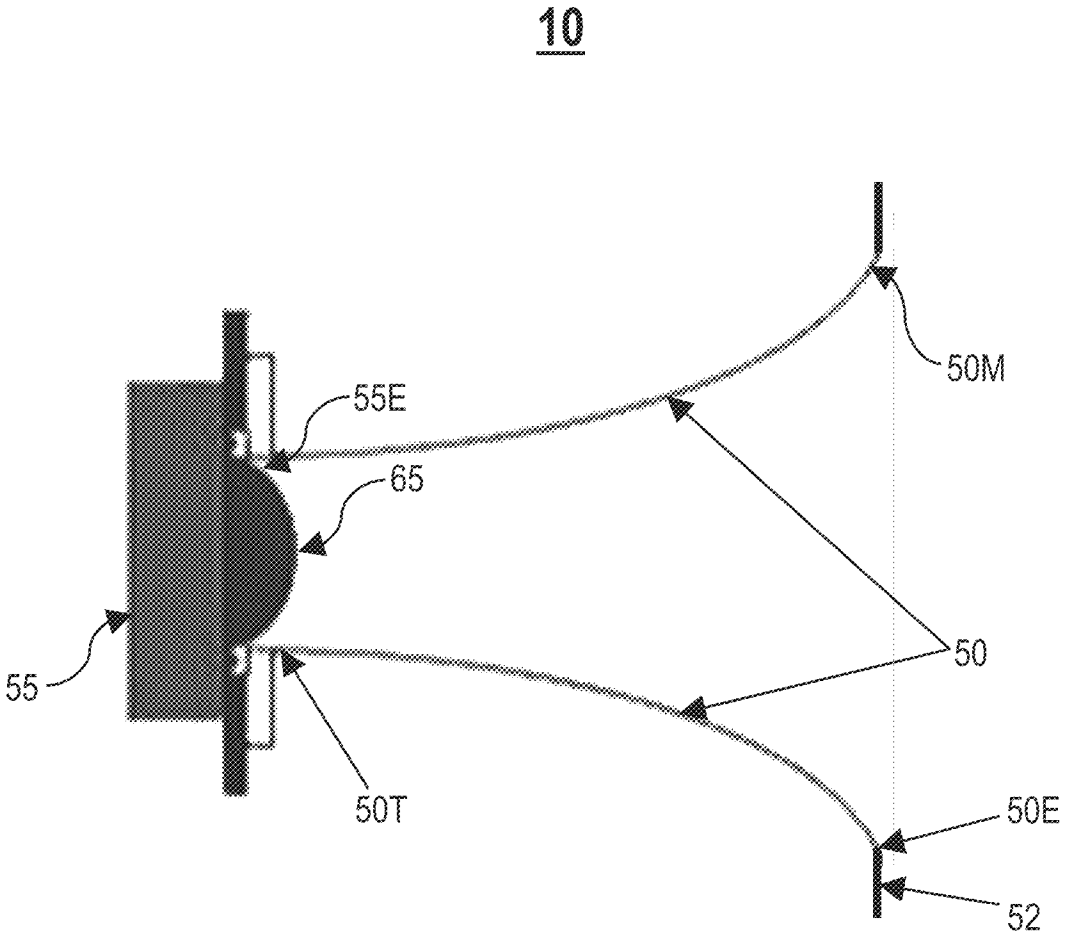
FIG. 2 illustrates a cross section of an example loudspeaker device comprising a speaker driver and an acoustic waveguide.

A loudspeaker device may include at least one acoustic waveguide for directing sound reproduced by at least one speaker driver of the loudspeaker device spatially. FIG. 2 illustrates a cross section of an example loudspeaker device 10 comprising a speaker driver 55 and an acoustic waveguide 50. As shown in FIG. 2, the waveguide 50 is positioned in front of a diaphragm 65 of the speaker driver 55. Unlike the diaphragm 65 which is a moving part of the speaker driver 55, the waveguide 50 is static and not a part of the speaker driver 55; the waveguide 50 is static when the speaker driver 55 reproduces sound.

The waveguide 50 includes a throat 50T positioned at one end of the waveguide 50 and within proximity of the diaphragm 65. The throat 50T defines a bottom portion (i.e., base) of the waveguide 50 that begins/starts at an exit 55E of the speaker driver 55.

The waveguide 50 further includes a mouth 50M positioned at an opposite end of the waveguide 50. The mouth 50M defines a top portion of the waveguide 50 that ends/terminates at a mouth exit/termination 50E defined as a cutout/opening in a top plane/plate/surface 52 where the mouth 50M joins/meets the top plane/plate/surface 52. A shape of the mouth exit/termination 50E may be circular, quadrilateral (e.g., a trapezoid, a square, a rectangle, etc.), elliptical, polygonal, or any other shape.

There is a gradual change in a cross sectional area of the waveguide 50 as the waveguide 50 transitions from the throat 50T to the mouth 50M (i.e., flare). During operation of the loudspeaker device 10, the waveguide 50 shapes propagation of acoustic energy reproduced by the speaker driver 55 to project the acoustic energy out of the mouth exit/termination 50E.

Unlike the diaphragm 65 that produces sound waves, the waveguide 50 does not produce sound waves. Instead, the waveguide 50 directs sound waves in a desired direction.

The top plane/plate/surface 52 can be substantially parallel to a horizontal axis, slanted, or curved.

For expository purposes, the term "hot spots" as used in this specification generally refers to effects of sound waves at particular frequencies at particular listening positions, wherein a listener at such positions either hears too much sound or too little sound at select frequency bands.

Conventionally, acoustic waveguides for loudspeaker devices exhibit seams or sharp elements/transitions (e.g., corners or edges) that result in "hot spots".

Embodiments of the invention provide an acoustic waveguide for beamwidth control and smooth off-axis frequency response for high frequency sound waves. In one embodiment, the waveguide does not exhibit any seams or sharp elements/transitions. The waveguide provides a frequency response at off-axis listening positions that drops smoothly and monotonously (i.e., smooth and monotonous decay) with sound waves of higher frequencies, resulting in a smooth change of timbre as a listener moves to different listening positions. The waveguide disperses sound to a beam that is kept as wide as possible, creating smoother frequency responses in a wider spatial area of the room (i.e., a wider sweet spot with minimal loss of high frequency soundwaves at off-axis listening positions).

Figure 3A:
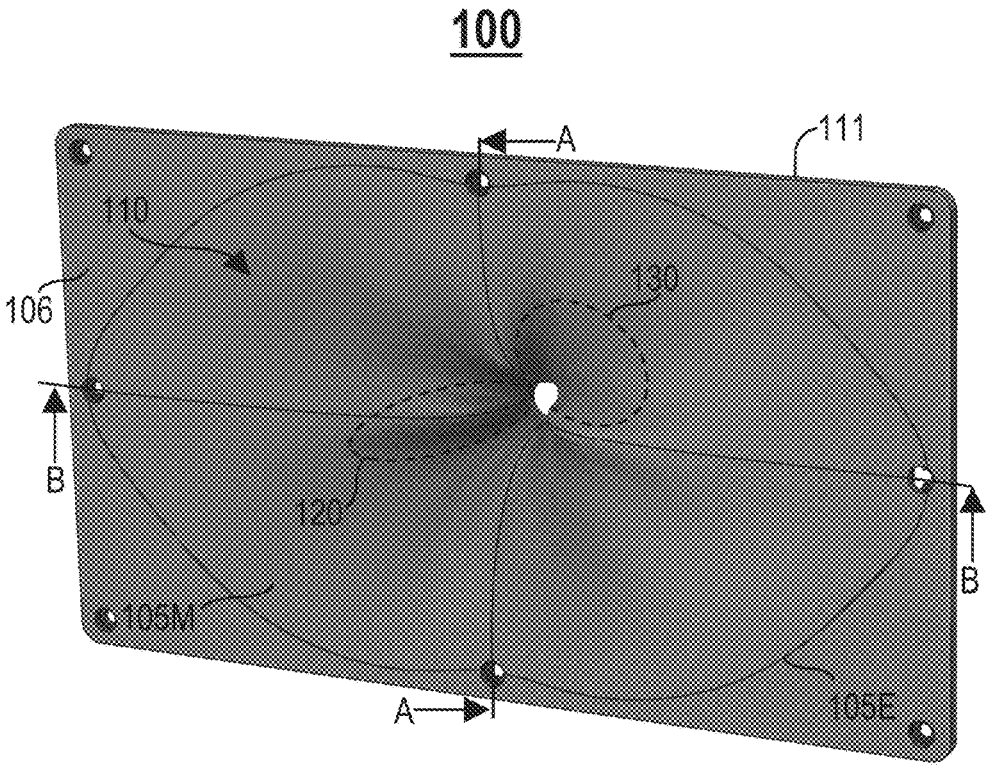
FIG. 3A illustrates a front perspective view of an example waveguide, in accordance with one embodiment.

One embodiment provides a waveguide with a clover-like shape to control beamwidth and provide smooth off-axis frequency response for high frequency (e.g., 2 kHz to 20 kHz) sound waves. FIG. 3A illustrates a front perspective view of an example waveguide 100, in accordance with one embodiment. The waveguide 100 can be incorporated in a loudspeaker device 10 to direct sound reproduced by a high frequency speaker driver 55 of the loudspeaker device 10 spatially.

The waveguide 100 comprises one or more smooth surfaces 110, one or more ridge areas ("ridges") 120 extending in a radial direction, and one or more recess areas ("recesses") 130. Each recess 130 is positioned in between a pair of ridges 120. Each smooth surface 110 connects a ridge 120 with a recess 130. As shown in FIG. 3A, each smooth surface 110 does not exhibit a seam or a sharp transition, thereby providing a smooth transition between a ridge 120 and a recess 130 that the smooth surface 110 interconnects. The smooth surfaces 110 reduce or eliminate drastic changes in frequency response when a listener moves from one listening position to another, thereby enabling the listener to experience minimally and smoothly varying frequency response as the listener moves (e.g., walks around a room, stands up, sits down).

A bottom/first portion of the waveguide 100 includes a throat 105T (FIG. 3D) that begins/starts at a throat entrance/start 105S (FIG. 3D) located within proximity of an exit of the speaker driver 55.

A top/final portion of the waveguide 100 includes a mouth 105M that ends/terminates at a mouth exit/termination 105E defined as a cutout/opening in a top plane/plate/surface 106 where the mouth 105M joins/meets the top plane/plate/surface 106. The mouth exit/termination 105E is a portion of the waveguide 100 that transitions between the mouth 105M and the top plane/plate/surface 106.

The top plane/plate/surface 106 has one or more outer edges/sides that together define an outer perimeter 111 of the waveguide 100. In one example embodiment, as shown in FIG. 3A, the outer perimeter 111 is substantially shaped as a rectangle.

The waveguide 100 disperses sound to a wider beam, creating smoother frequency responses in a wider spatial area of a room. In one embodiment, the recesses 130 are arranged and designed/shaped as smooth clover-like transitions that provide a wide coverage angle (i.e., wide sweet spot). In another embodiment, the recesses 130 have different arrangements and designs/shapes.

Unlike conventional acoustic waveguides that exhibit seams or sharp transitions that result in "hot spots", the smooth surfaces 110 remove occurrences of such hot spots.

The ridges 120 control sound directivity of high frequency sound waves produced by the speaker driver 55 in the horizontal and vertical planes, providing a smooth off-axis frequency response for the sound waves in both of these planes. In one embodiment, the ridges 120 and the recesses 130 also control how sound is directed at oblique angles.

Acoustic impedance of air at a throat of the waveguide 100 may be high, whereas acoustic impedance of air at a mouth of the waveguide 100 may be low. The waveguide 100 creates a smooth acoustic impedance match. Without the waveguide 100, the impedance transition for air is not smooth, resulting in a frequency response that is not smooth (e.g., EQ required).

For example, the ridges 120 may alter acoustic impedance of air that the speaker driver 55 encounters. To counter this effect, the recesses 130 help balance the acoustic impedance to keep an off-axis frequency response for sound waves produced by the speaker driver 55 as flat as possible.

The waveguide 100 is mountable to a mounting surface (not shown) of the loudspeaker device 10, such as a baffle.

Lines A-A and B-B are shown in FIG. 3A for illustration purposes only. With reference to lines A-A and B-B, different cross sectional views of the waveguide 100 taken along these lines are described later herein.

In one embodiment, the mouth 105M of the waveguide 100 smoothly and continually transitions to the top plane/plate/surface 106 at an angle about the mouth exit/termination 105E (i.e., a tangency angle is formed between the mouth 105M and the top plane/plate/surface 106, such that the waveguide 100 ends substantially tangential to the top plane/plate/surface 106).

In one embodiment, a throat of the waveguide 100 smoothly and continually transitions from an exit of the speaker driver 55 at an angle about a throat entrance/start 105S (i.e., a tangency angle is formed between the throat entrance/start 105S and the exit of the speaker driver 55, such that the waveguide 100 starts substantially tangential to the exit of the speaker driver 55).

Figure 3B:
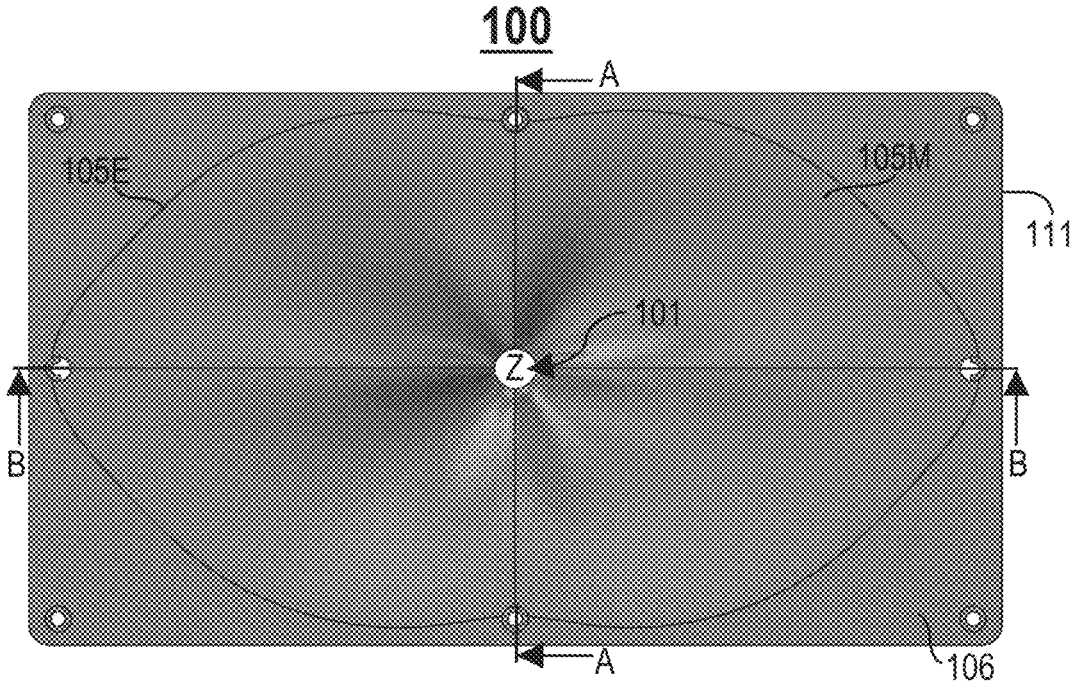
FIG. 3B illustrates a front view of the waveguide in FIG. 3A, in accordance with one embodiment.

FIG. 3B illustrates a front view of the waveguide 100 in FIG. 3A, in accordance with one embodiment. In one embodiment, the waveguide 100 comprises a hole 101 (FIG. 3B) positioned substantially at a center Z of the waveguide 100.

Figure 3C:
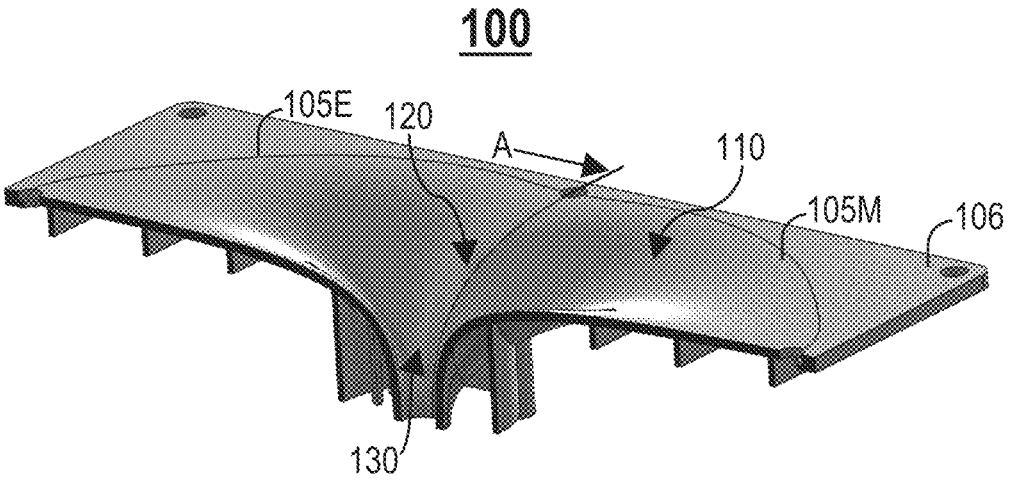
FIG. 3C illustrates a top perspective cross sectional view of the waveguide in FIG. 3A taken along a line B-B, in accordance with one embodiment.
Figure 3D:
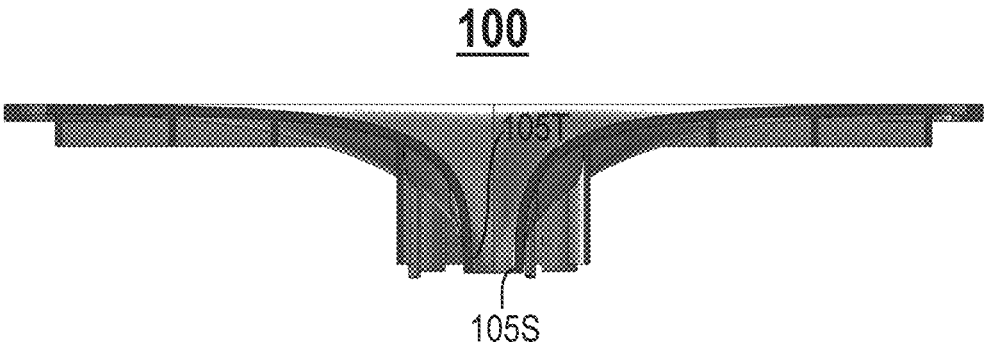
FIG. 3D illustrates a cross sectional view of the waveguide in FIG. 3A taken along the line B-B, in accordance with one embodiment.
Figure 3E:
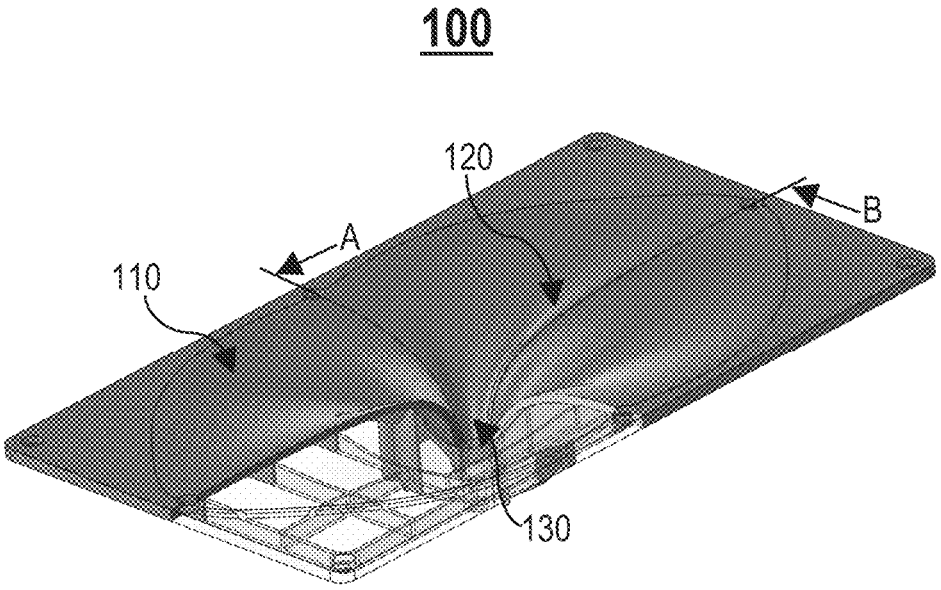
FIG. 3E illustrates a top perspective view of the waveguide in FIG. 3A with a portion of the waveguide removed, in accordance with one embodiment.
Figure 3F:
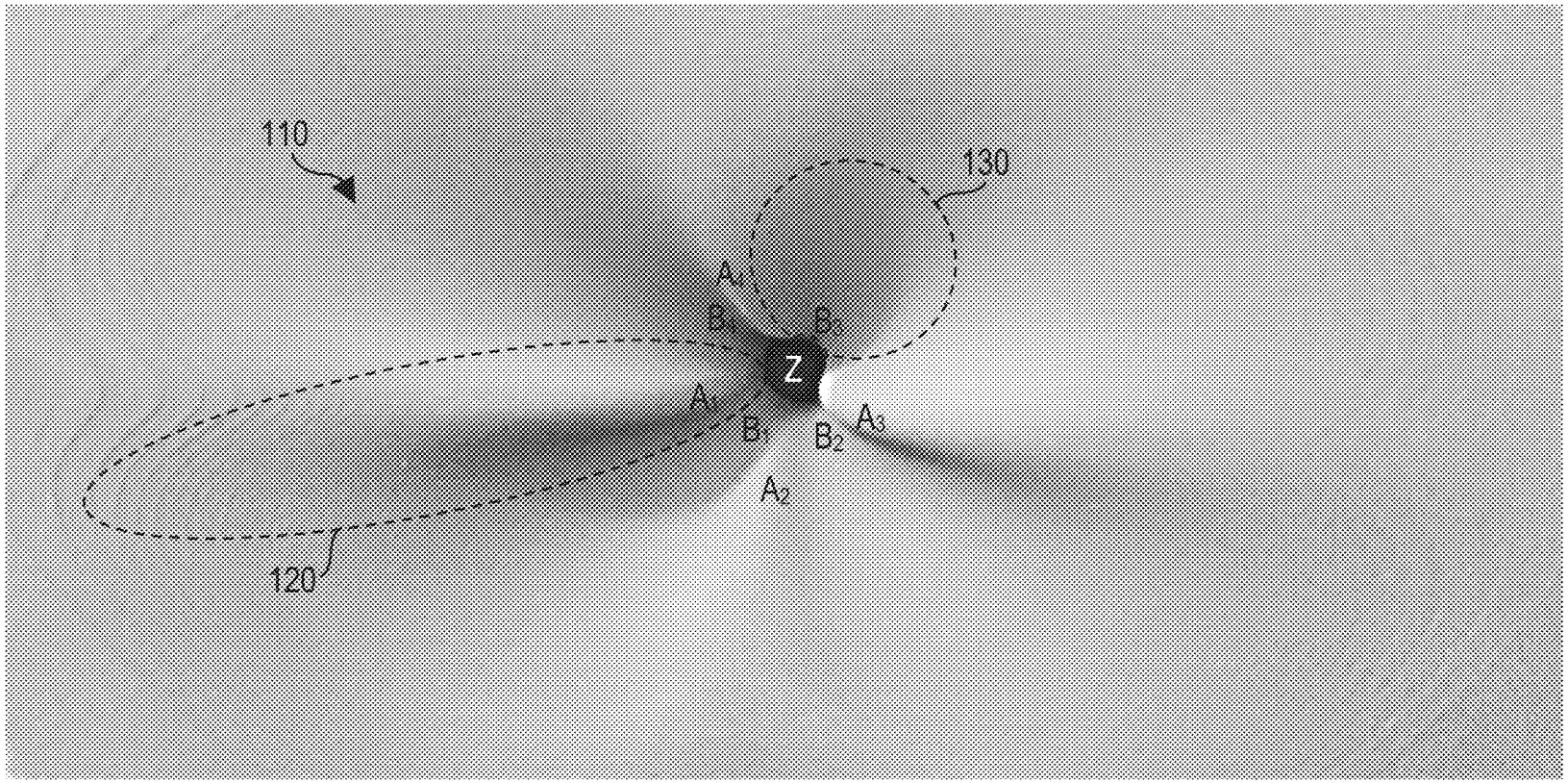
FIG. 3F illustrates a close up view of the waveguide in FIG. 3A, in accordance with one embodiment.

FIG. 3C illustrates a top perspective cross sectional view of the waveguide 100 in FIG. 3A taken along the line B-B, in accordance with one embodiment. FIG. 3D illustrates a cross sectional view of the waveguide 100 in FIG. 3A taken along the line B-B, in accordance with one embodiment. FIG. 3E illustrates a top perspective view of the waveguide 100 in FIG. 3A with a portion of the waveguide 100 extending along half of the line B-B and half of the line A-A removed, in accordance with one embodiment. FIG. 3F illustrates a close up view of the waveguide 100 in FIG. 3A, in accordance with one embodiment. In one embodiment, an optimal number of ridges required for a waveguide 100 to provide symmetric sound directivity with respect to the horizontal and vertical planes is four. As shown in FIGS. 3A-3F, in one embodiment, the waveguide 100 has four ridges 120, such as a first ridge $A_1$, a second ridge $A_2$, a third ridge $A_3$, and a fourth ridge $A_4$. As further shown in FIGS. 3A-3F, in one embodiment, the waveguide 100 has four recesses 130, such as a first recess $B_1$ positioned in between the ridges $A_1$ and $A_2$, a second recess $B_2$ positioned in between the ridges $A_2$ and $A_3$, a third recess $B_3$ positioned in between the ridges $A_3$ and $A_4$, and a fourth recess $B_4$ positioned in between the ridges $A_4$ and $A_1$.

In another embodiment, the waveguide 100 has a different number of ridges 120 and recesses 130.

In situations where planes other than the horizontal and vertical planes are important for precise sound directivity control, an optimal number of ridges and orientation of the ridges required for a waveguide 100 may be different. For example, in one embodiment, an optimal number of ridges required for a waveguide 100 for a particular loudspeaker device 10 may be one.

In one embodiment, opposing ridges 120 (e.g., left and right ridges, or top and bottom ridges) of a waveguide 100 need not be symmetric. For example, if a loudspeaker device 10 is positioned close to a side wall, it may be beneficial to design a waveguide 100 for the loudspeaker device 100 that produces an asymmetric directivity with respect to the vertical plane.

In one embodiment, the waveguide 100 can be incorporated in high frequency audio systems.

In one embodiment, the waveguide 100 can be used to direct sound produced from a compression driver.

In one embodiment, the waveguide 100 can be incorporated in large loudspeaker systems, such as systems for professional audio or cinema applications.

The waveguide 100 can be manufactured using existing manufacturing techniques, such as molding, machining, casting, etc.

Typically, optimizing a design/shape of a conventional acoustic waveguide involves multiple steps, specifically optimizing horizontal directivity of the waveguide, separately optimizing vertical directivity of the waveguide, and combining the resulting optimizations.

In one embodiment, optimizing a design/shape of the waveguide 100 involves only a single optimization routine that simultaneously optimizes horizontal directivity and vertical directivity of the waveguide 100. Simultaneously optimizing the horizontal directivity and vertical directivity results in good sound quality at any listening position in space (i.e., horizontal planes, vertical planes, and even oblique planes within a spatial area of a room). This ensures a smooth change of timbre when a listener changes listening positions.

In one embodiment, a waveguide 100 is parameterized using different cross sectional profiles. FIG. 4A illustrates a front view of the waveguide 100 in FIG. 3A with different cross sectional profiles shown, in accordance with one embodiment. In one embodiment, the following cross sectional profiles are used to parameterize the smooth surfaces 110 of the waveguide 100: (1) a first cross sectional profile 200 representing a cross section of the waveguide 100 in a vertical direction (i.e., vertical plane), (2) a second cross sectional profile 210 representing a cross section of the waveguide 100 in a horizontal direction (i.e., horizontal plane), and (3) a third cross sectional profile 220 representing a cross section of the waveguide 100 in the 45° direction (i.e., oblique plane).

Figure 5A:
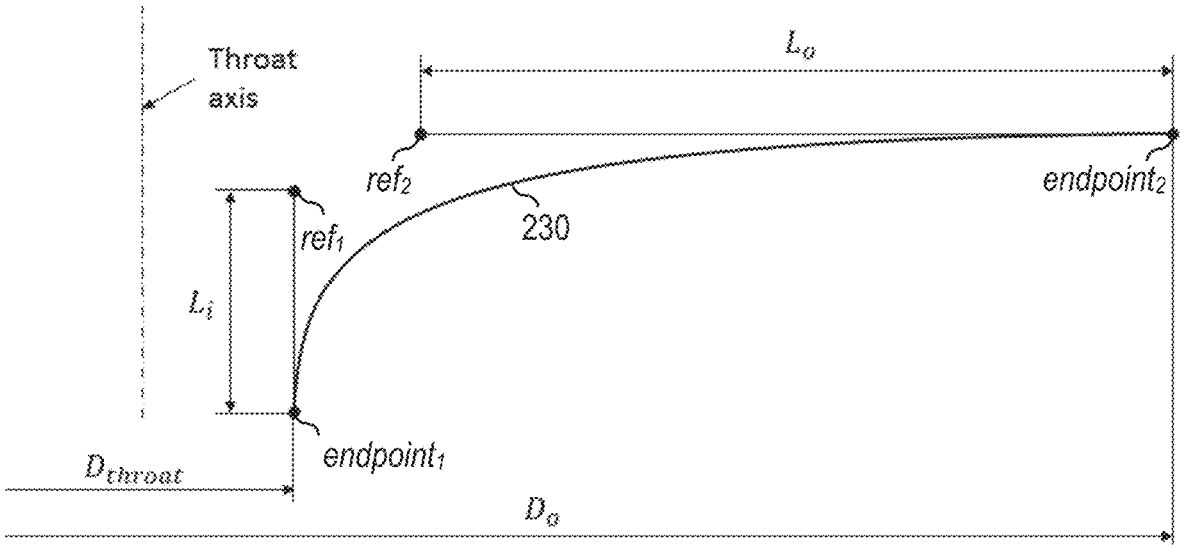
FIG. 5A illustrates parameterization of an example cubic Bezier curve, in accordance with one embodiment.

For expository purposes, the term "throat axis" as used in this specification generally refers to a central longitudinal axis of a waveguide that is substantially perpendicular to a speaker driver that the waveguide is positioned in front of FIG. 5A illustrates an example of a throat axis.

For expository purposes, the term "throat tangency angle" as used in this specification generally refers to a tangency angle formed between a throat axis and a tangent line of a cross-sectional profile at a throat entrance/start of a waveguide. For expository purposes, the term "mouth tangency angle" as used in this specification generally refers to a tangency angle formed between a top plane/plate/surface and a tangent line of a cross-sectional profile at a mouth exit/termination of a waveguide.

Figure 4B:
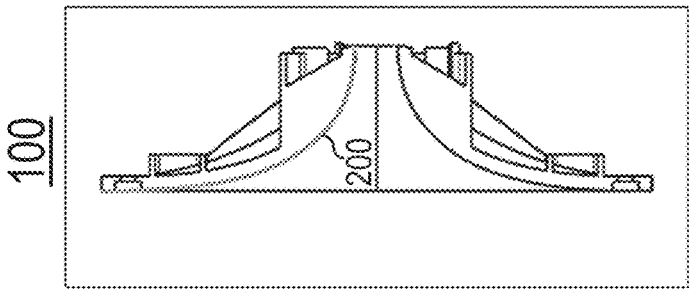
FIG. 4B illustrates a cross sectional view of the waveguide in FIG. 3A taken along a line A-A, in accordance with one embodiment.
Figure 4A:
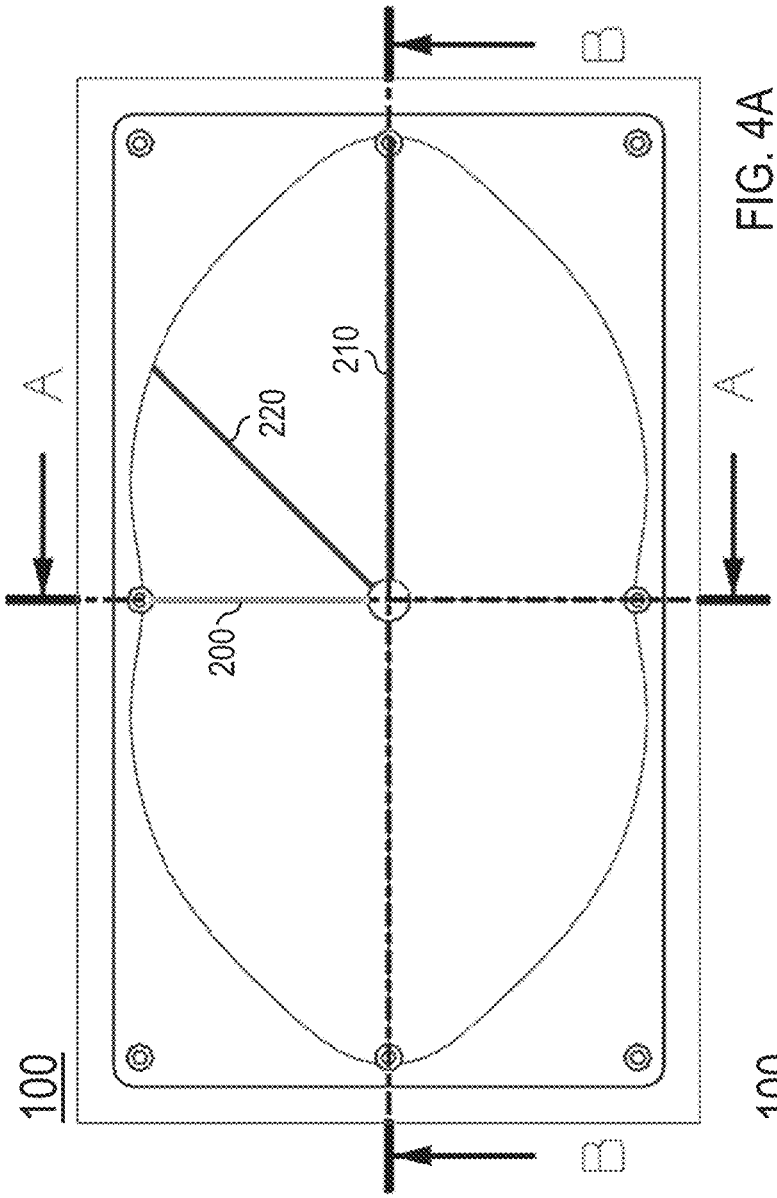
FIG. 4A illustrates a front view of the waveguide in FIG. 3A with different cross sectional profiles shown, in accordance with one embodiment.
Figure 4C:
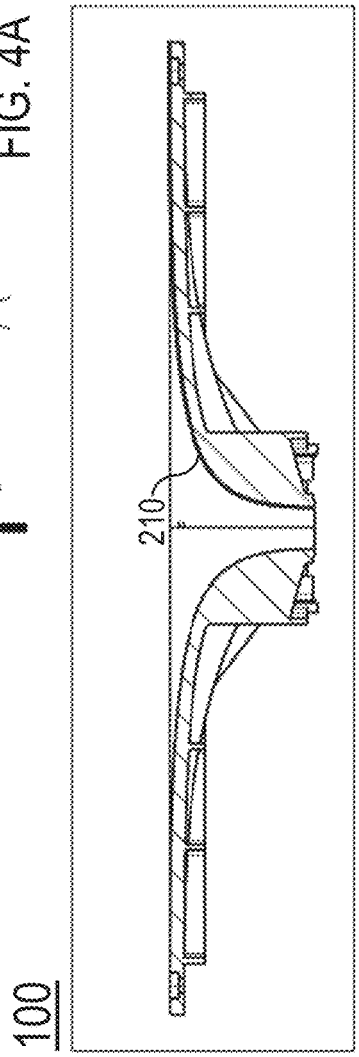
FIG. 4C illustrates a cross sectional view of the waveguide 100 in FIG. 3A taken along the line B-B, in accordance with one embodiment.

FIG. 4B illustrates a cross sectional view of the waveguide 100 in FIG. 3A taken along the line A-A with the cross sectional profile 200 shown, in accordance with one embodiment. FIG. 4C illustrates a cross sectional view of the waveguide 100 in FIG. 3A taken along the line B-B with the cross sectional profile 210 shown, in accordance with one embodiment. In one example embodiment, each cross sectional profile 200, 210, and 220 has the following degrees of freedom: (1) throat tangency angle at a throat of the waveguide 100, (2) tangency strength at the throat, (3) outer radius at a mouth of the waveguide 100 (alternatively, outer diameter), (4) mouth tangency angle at the mouth, and (5) tangency strength at the mouth. In this example embodiment, this provides up to 13 design parameters total (i.e., each cross sectional profile has 4 design parameters relating to tangency angles and tangency strengths; the design parameter relating to the outer radius is the same across all the cross sectional profiles). These design parameters can be provided as inputs to the single optimization routine. An ideal/optimal combination of design parameters is identified using optimization with simulations to achieve a target smooth off-axis frequency response with a wide coverage angle (i.e., the design parameters are strategically varied until the ideal/optimal combination of design parameters is found).

In one embodiment, an inner radius at the throat (alternatively, throat diameter) is fixed. For example, if the throat continues seamlessly with the shape of an exit of the speaker driver 55 (i.e., tangential throat), an inner radius at the throat is given by the exit of the speaker driver 55. In one embodiment, an outer radius at the mouth (i.e., outer diameter) is fixed. For example, outer endpoints of a cross sectional profile are given by a size of the loudspeaker device 10 (e.g., available width and height for the loudspeaker device 10). In one embodiment, a depth of the waveguide 100 is fixed.

In one embodiment, each cross sectional profile 200, 210, and 220 is defined by a corresponding cubic Bezier curve. In another embodiment, each cross sectional profile 200, 210, and 220 is defined using another parameterization method, such as spine curves, piecewise linear, etc.

FIG. 5A illustrates parameterization of an example cubic Bezier curve 230, in accordance with one embodiment. The curve 230 is parameterized by its two endpoints, $endpoint_1$ and $endpoint_2$, and tangency angle/strength at these endpoints. In one embodiment, the endpoints $endpoint_1$ and $endpoint_2$ are given as the endpoints are based on the following fixed design parameters: the diameter of the throat $D_{throat}$ (the diameter of the throat is twice the inner radius at the throat), the depth of the waveguide 100, and the outer diameter $D_o$ (the outer diameter is twice the outer radius at the mouth). The tangency angle/strength at the endpoints $endpoint_1$ and $endpoint_2$ are parameterized by two lengths $L_i$ and $L_o$, wherein $L_i$ is a length between the endpoint $endpoint_1$ and a point $ref_1$ where the throat is tangential to the axial direction, and Lois a length between the endpoint $endpoint_2$ and a point $ref_2$ where the mouth is tangential to a surface of a baffle.

Figure 5B:
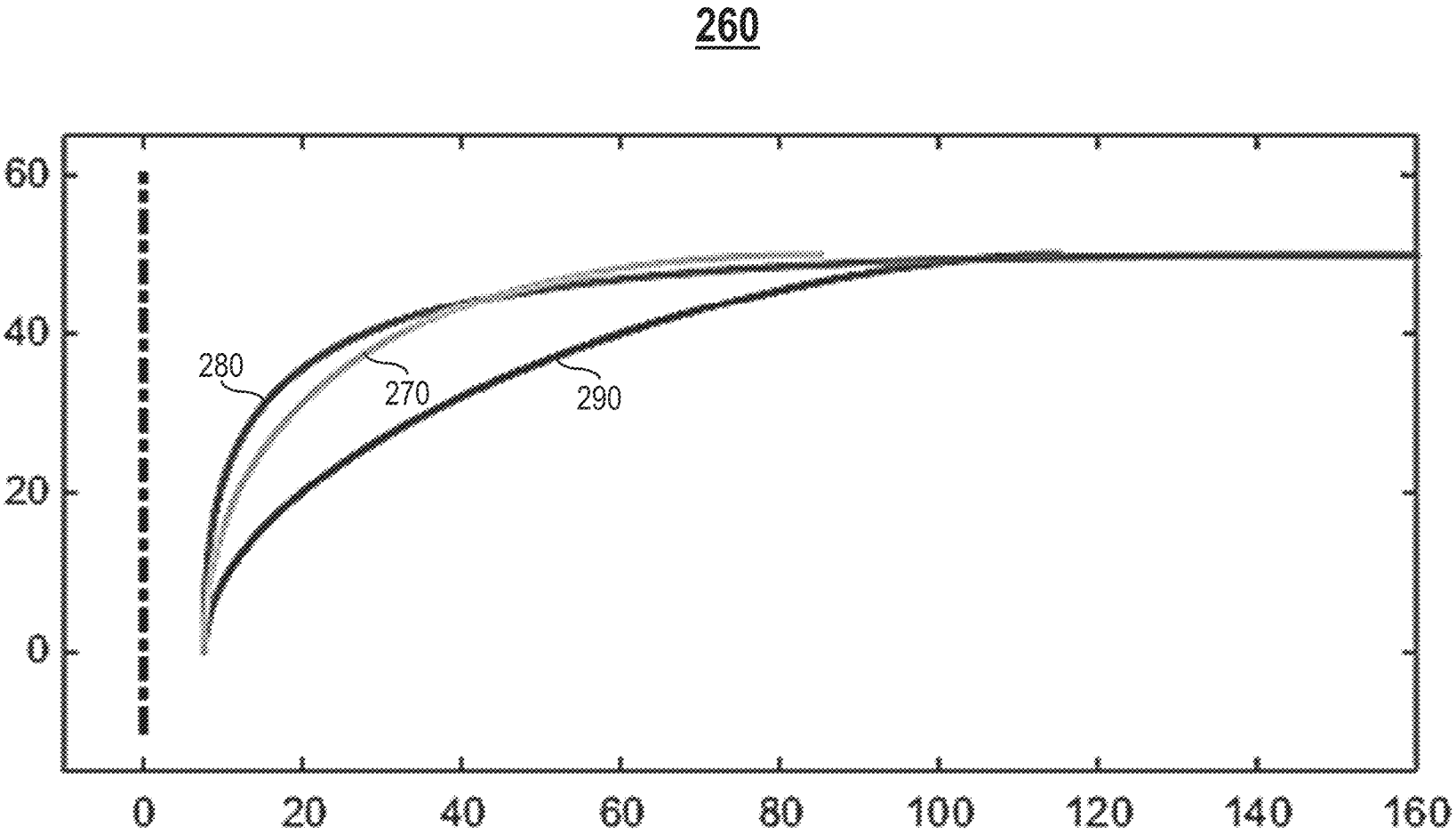
FIG. 5B is an example graph illustrating different cubic Bezier curves defining the different cross sectional profiles in FIG. 4A, in accordance with one embodiment.

FIG. 5B is an example graph 260 illustrating different cubic Bezier curves defining the different cross sectional profiles in FIG. 4A, in accordance with one embodiment. A horizontal axis of the graph 260 represents a radial coordinate (e.g., distance from a throat axis) in units of length expresses in millimeters (mm). A vertical axis of the graph 260 represents a depth coordinate along a throat axis (e.g., distance from a throat entrance/start) in units of length expressed in mm. The graph 260 comprises a first cubic Bezier curve 270 defining the first cross sectional profile 200 (i.e., the cross section of the waveguide 100 in the vertical direction), a second cubic Bezier curve 280 defining the second cross sectional profile 210 (i.e., the cross section of the waveguide 100 in the horizontal direction), and a third cubic Bezier curve 290 defining the third cross sectional profile 220 (i.e., the cross section of the waveguide 100 in the 45° direction).

In one embodiment, the waveguide 100 has a throat tangency angle that is substantially zero degrees. In another embodiment, the waveguide 100 has a throat tangency angle that is non-zero (e.g., FIG. 12C). In one embodiment, the waveguide 100 has a mouth tangency angle that is substantially zero degrees. In another embodiment, the waveguide 100 has a mouth tangency angle that is non-zero (e.g., FIG. 12B).

Based on the cross sectional profiles 200, 210, and 220, a computer-aided design (CAD) program is used to generate a smooth surface that goes through the cross sections represented by the profiles 200, 210, and 220. Based on the resulting smooth surface, sound directivity of the waveguide is predicted via simulations (e.g., using simulation software).

To achieve a particular measure of sound directivity (e.g., wide beamwidths and smooth off-axis frequency response), designing the waveguide 100 further includes defining/setting one or more target off-axis frequency responses at one or more off-axis angles (i.e., directions) relative to an on-axis frequency response to achieve the particular measure of sound directivity. FIG. 6A is an example log-frequency plot 300 illustrating different frequency responses in the horizontal plane, in accordance with one embodiment. A horizontal axis of the plot 300 represents a frequency domain in log scale expressed in Hz units. A vertical axis of the plot 300 represents a difference in sound power levels (SPLs) expressed in decibel (dB) units. The plot 300 comprises the following: (1) a flat on-axis frequency response 301, (2) a linear off-axis frequency response 310 at an off-axis angle of 20° that represents a target, (3) an off-axis frequency response 311 at an off-axis angle of 20° that represents a simulated result, (4) an off-axis frequency response 312 at an off-axis angle of 20° that represents a measured result for the waveguide 100 shown in FIGS. 3A-3F, (5) an off-axis frequency response 320 at an off-axis angle of 40° that represents a simulated result, (6) an off-axis frequency response 321 at an off-axis angle of 40° that represents a measured result for the waveguide 100 shown in FIGS. 3A-3F, (7) a linear off-axis frequency response 330 at an off-axis angle of 60° that represents a target, (8) an off-axis frequency response 331 at an off-axis angle of 60° that represents a simulated result, (9) an off-axis frequency response 332 at an off-axis angle of 60° that represents a measured result for the waveguide 100 shown in FIGS. 3A-3F, (10) an off-axis frequency response 340 at an off-axis angle of 80° that represents a simulated result, and (11) an off-axis frequency response 341 at an off-axis angle of 80° that represents a measured result for the waveguide 100 shown in FIGS. 3A-3F. Each off-axis frequency response shown in FIG. 6A is normalized to the on-axis frequency response 301.

Figure 6B:
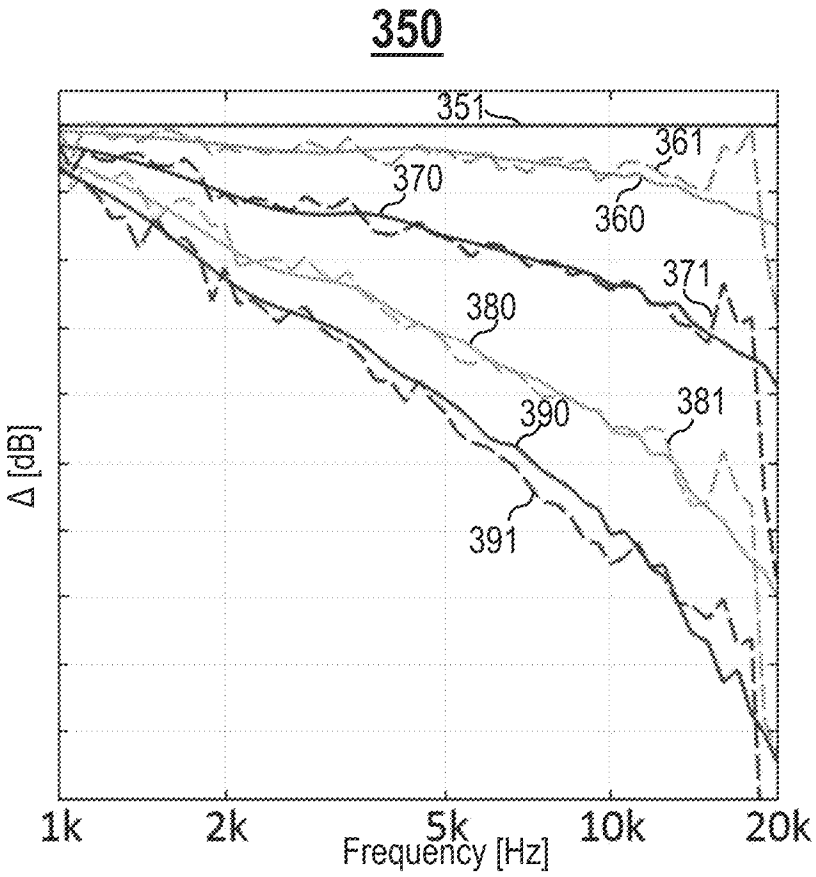
FIG. 6B is an example log-frequency plot illustrating different frequency responses in a vertical plane, in accordance with one embodiment.
Figure 6A:
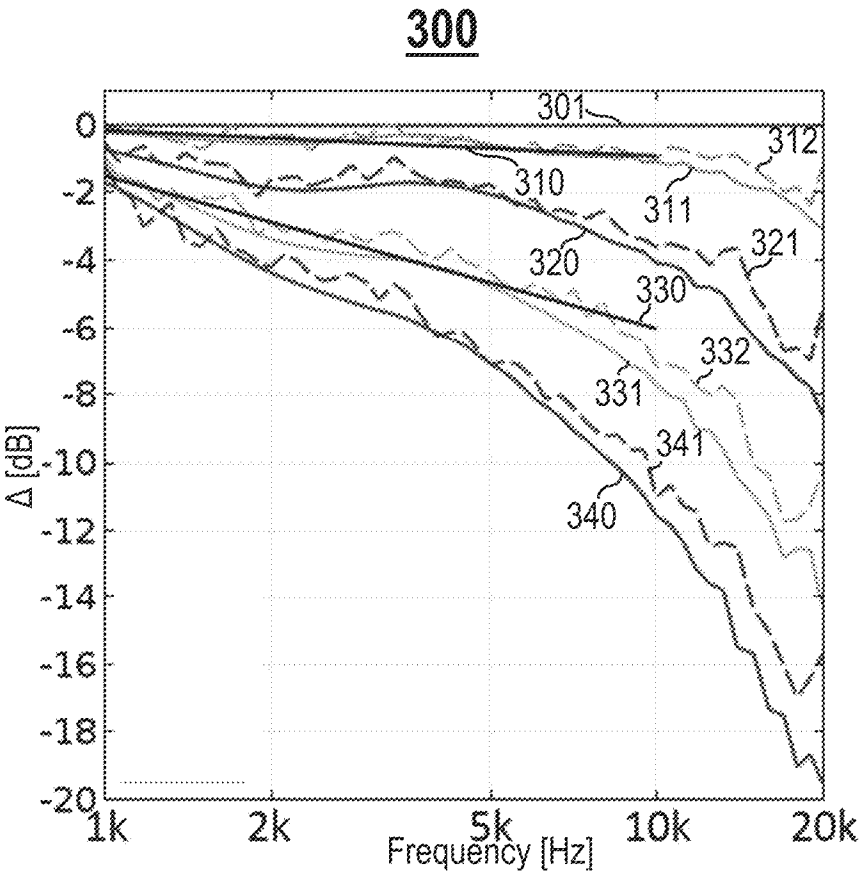
FIG. 6A is an example log-frequency plot illustrating different frequency responses in a horizontal plane, in accordance with one embodiment.

FIG. 6B is an example log-frequency plot 350 illustrating different frequency responses in the vertical plane, in accordance with one embodiment. A horizontal axis of the plot 350 represents a frequency domain in log scale expressed in Hz units. A vertical axis of the plot 350 represents a difference in SPLs expressed in dB units. The plot 350 comprises the following: (1) a flat on-axis frequency response 351, (2) an off-axis frequency response 360 at an off-axis angle of 20° that represents a simulated result, (3) an off-axis frequency response 361 at an off-axis angle of 20° that represents a measured result for the waveguide 100 shown in FIGS. 3A-3F, (4) an off-axis frequency response 370 at an off-axis angle of 40° that represents a simulated result, (5) an off-axis frequency response 371 at an off-axis angle of 40° that represents a measured result for the waveguide 100 shown in FIGS. 3A-3F, (6) an off-axis frequency response 380 at an off-axis angle of 60° that represents a simulated result, (7) an off-axis frequency response 381 at an off-axis angle of 60° that represents a measured result for the waveguide 100 shown in FIGS. 3A-3F, (8) an off-axis frequency response 390 at an off-axis angle of 80° that represents a simulated result, and (9) an off-axis frequency response 391 at an off-axis angle of 80° that represents a measured result for the waveguide 100 shown in FIGS. 3A-3F. Each off-axis frequency response shown in FIG. 6B is normalized to the on-axis frequency response 351.

As shown in FIGS. 6A-6B, the off-axis frequency responses drop monotonically and smoothly with increasing off-axis angles and increasing frequencies. This reflects a sound field that a listener will perceive as very pleasing to the ear as the listener moves listening positions.

Figure 7B:
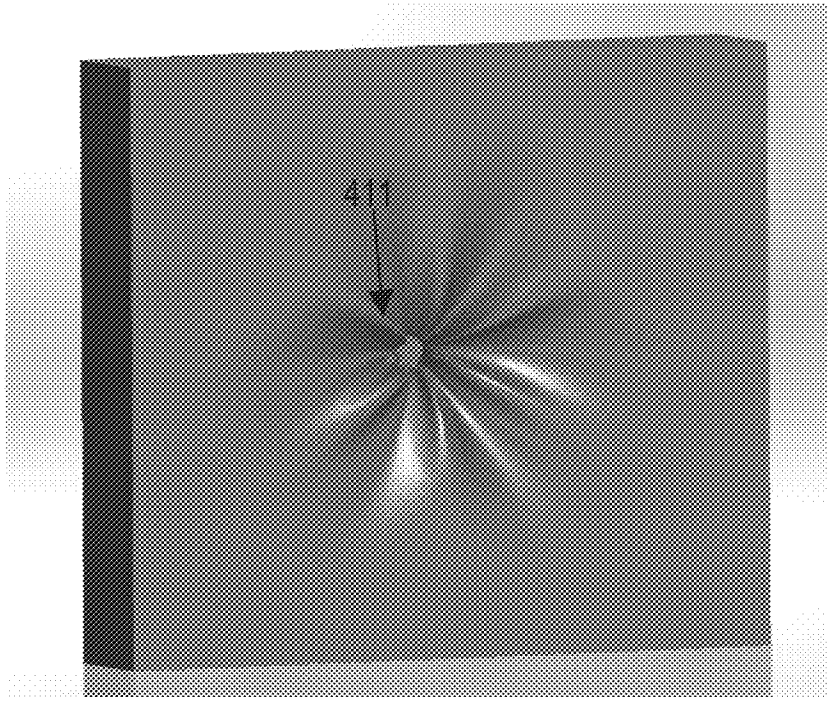
FIG. 7B illustrates another example waveguide with more ridges than the waveguide in FIG. 3A, in accordance with one embodiment.
Figure 7A:
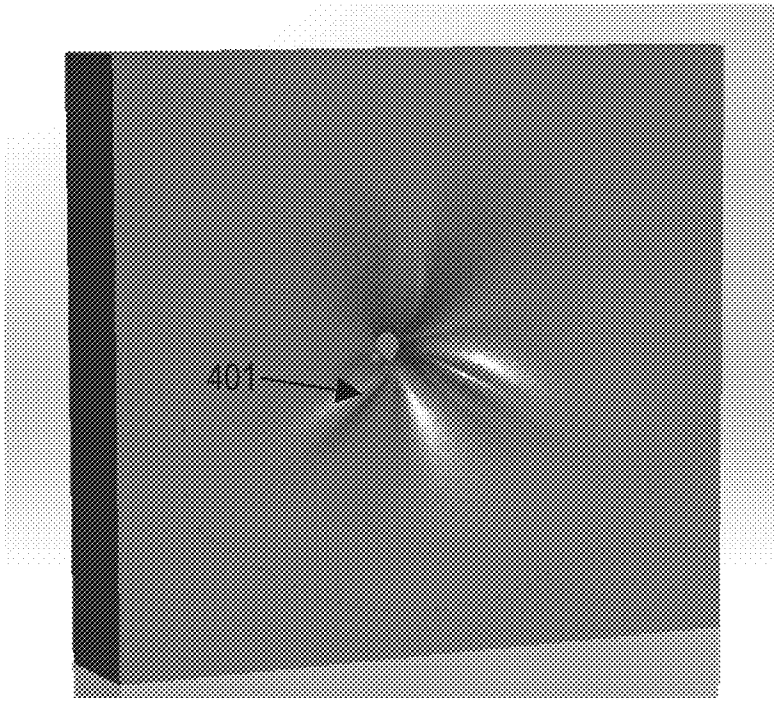
FIG. 7A illustrates another example waveguide with fewer ridges than the waveguide in FIG. 3A, in accordance with one embodiment.

FIGS. 7A-7B illustrate alternative embodiments of waveguides for the loudspeaker device 10 with variations in number of ridges and recesses. FIG. 7A illustrates another example waveguide 400 with fewer ridges than the waveguide 100 in FIG. 3A, in accordance with one embodiment. Unlike the waveguide 100, the waveguide 400 comprises three ridges 401.

FIG. 7B illustrates another example waveguide 410 with more ridges than the waveguide 100 in FIG. 3A, in accordance with one embodiment. Unlike the waveguide 100, the waveguide 410 comprises six ridges 411.

Figure 8A:
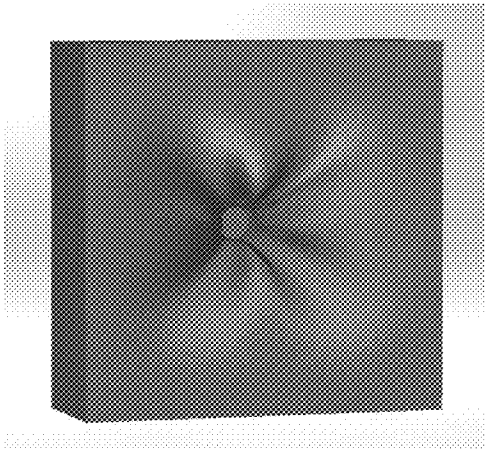
FIG. 8A illustrates another example waveguide with identical horizontal and vertical dimensions, in accordance with one embodiment.
Figure 8B:
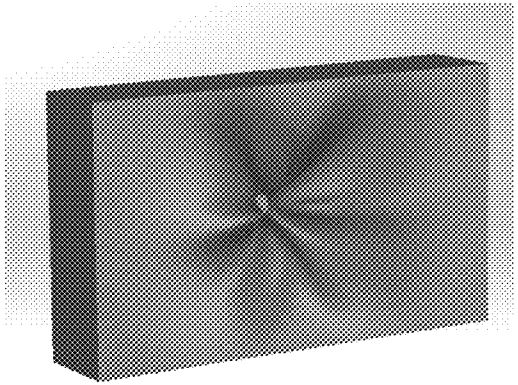
FIG. 8B illustrates another example waveguide with larger horizontal dimensions than vertical dimensions, in accordance with one embodiment.
Figure 8C:
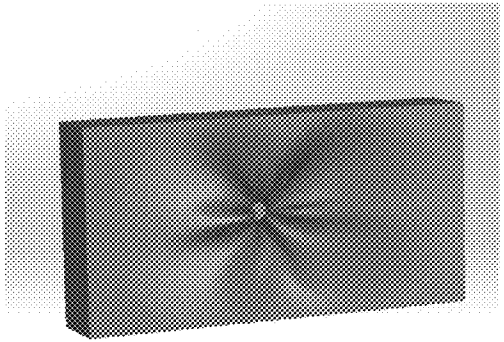
FIG. 8C illustrates another example waveguide with even larger horizontal dimensions than vertical dimensions, in accordance with one embodiment.

FIGS. 8A-8C illustrate alternative embodiments of waveguides for the loudspeaker device 10 with different aspect ratios of horizontal dimensions to vertical dimensions. Each aspect ratio corresponding to a waveguide reflects amount of distance, in the horizontal and vertical directions, between a mouth exit/termination of the waveguide and a baffle that the waveguide is mounted on. FIG. 8A illustrates another example waveguide 420 with identical horizontal and vertical dimensions, in accordance with one embodiment. The waveguide 420 has an aspect ratio of 1:1 (i.e., horizontal and vertical dimensions are the same).

FIG. 8B illustrates another example waveguide 430 with larger horizontal dimensions than vertical dimensions, in accordance with one embodiment. The waveguide 430 has an aspect ratio of $\sqrt{2}$:1 (i.e., horizontal dimensions are about $\sqrt{2}$ more that vertical dimensions).

FIG. 8C illustrates another example waveguide 440 with even larger horizontal dimensions than vertical dimensions, in accordance with one embodiment. The waveguide 440 has an aspect ratio of 2:1 (i.e., horizontal dimensions are about two times more that vertical dimensions).

Figure 9B:
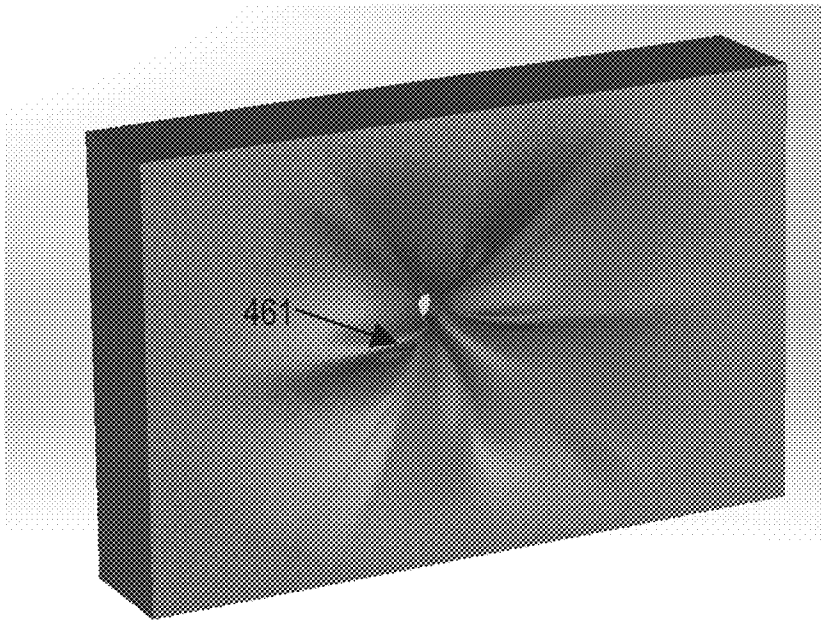
FIG. 9B illustrates another example waveguide with narrow ridges, in accordance with one embodiment.
Figure 9A:
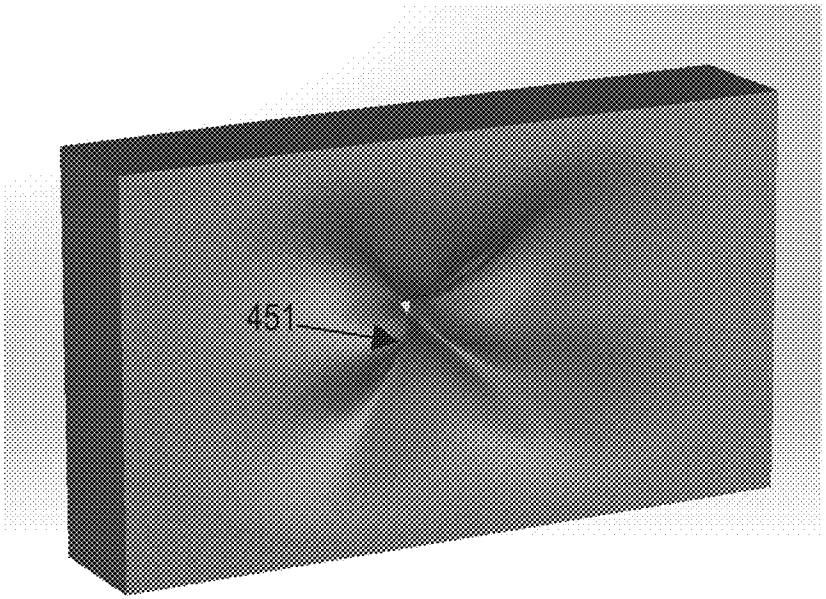
FIG. 9A illustrates another example waveguide with wide ridges, in accordance with one embodiment.

FIGS. 9A-9B illustrate alternative embodiments of waveguides for the loudspeaker device 10 with variations in width of ridges and recesses. FIG. 9A illustrates another example waveguide 450 with wide ridges 451, in accordance with one embodiment. The ridges 451 of the waveguide 450 are wider than the ridges 120 of the waveguide 100 in FIG. 3A.

FIG. 9B illustrates another example waveguide 460 with narrow ridges 461, in accordance with one embodiment. The ridges 461 of the waveguide 460 are narrower than the ridges 120 of the waveguide 100 in FIG. 3A.

Figure 10B:
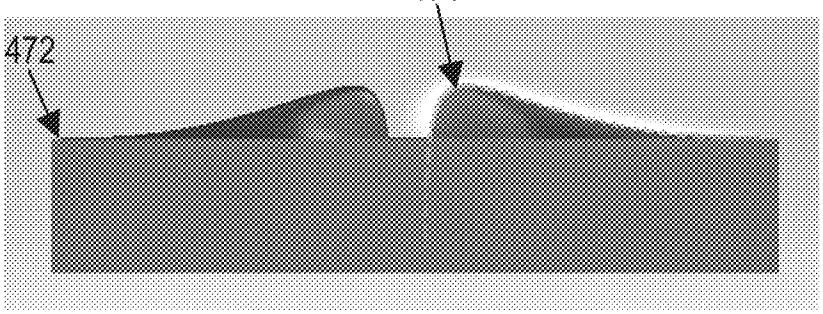
FIG. 10B illustrates a cross sectional view of the waveguide in FIG. 10A, in accordance with one embodiment.
Figure 10A:
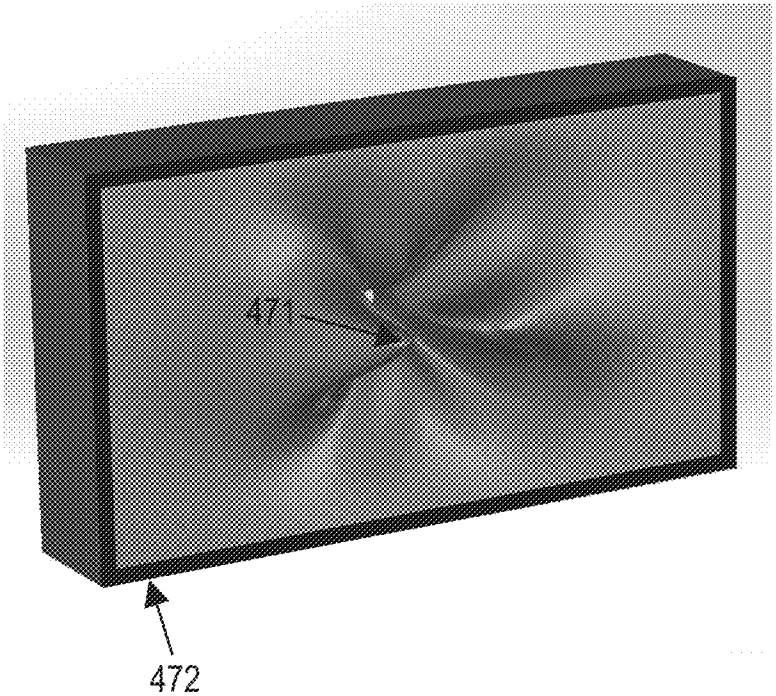
FIG. 10A illustrates another example waveguide with protruding ridges, in accordance with one embodiment.

FIGS. 10A-10B illustrate an alternative embodiment of a waveguide for the loudspeaker device 10 with ridges that extend/protrude beyond a plane of a baffle that the waveguide is mounted on. FIG. 10A illustrates another example waveguide 470 with protruding ridges 471, in accordance with one embodiment. FIG. 10B illustrates a cross sectional view of the waveguide 470 in FIG. 10A, in accordance with one embodiment. The ridges 471 protrude beyond a plane of a baffle 472 that the waveguide 471 is mounted to.

FIGS. 11A-11C illustrate alternative embodiments of waveguides for the loudspeaker device 10 with different outer perimeters. FIG. 11A illustrates another example waveguide 480 with a circular outer perimeter 481, in accordance with one embodiment. The outer perimeter 481 is substantially shaped as a circle. FIG. 11B illustrates another example waveguide 490 with a hexagonal outer perimeter 491, in accordance with one embodiment. The outer perimeter 491 is substantially shaped as a hexagon. FIG. 11C illustrates another example waveguide 500 with a triangular outer perimeter 501, in accordance with one embodiment. The outer perimeter 501 is substantially shaped as a triangle.

Figure 12B:
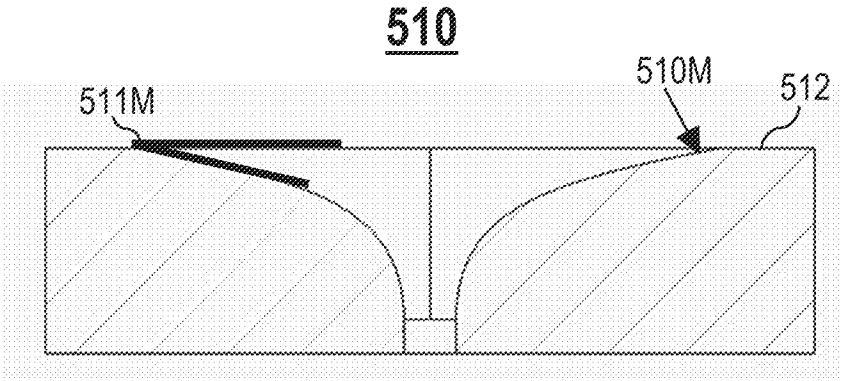
FIG. 12B illustrates a cross sectional view of the waveguide in FIG. 12A with the non-tangential mouth referenced, in accordance with one embodiment.
Figure 12C:
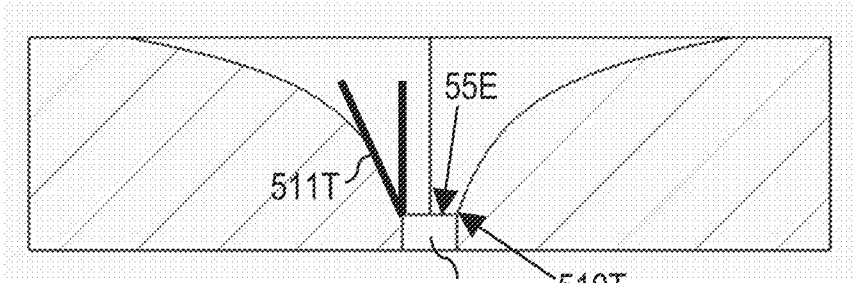
FIG. 12C illustrates a cross sectional view of the waveguide in FIG. 12A with the non-tangential throat referenced, in accordance with one embodiment.
Figure 12A:
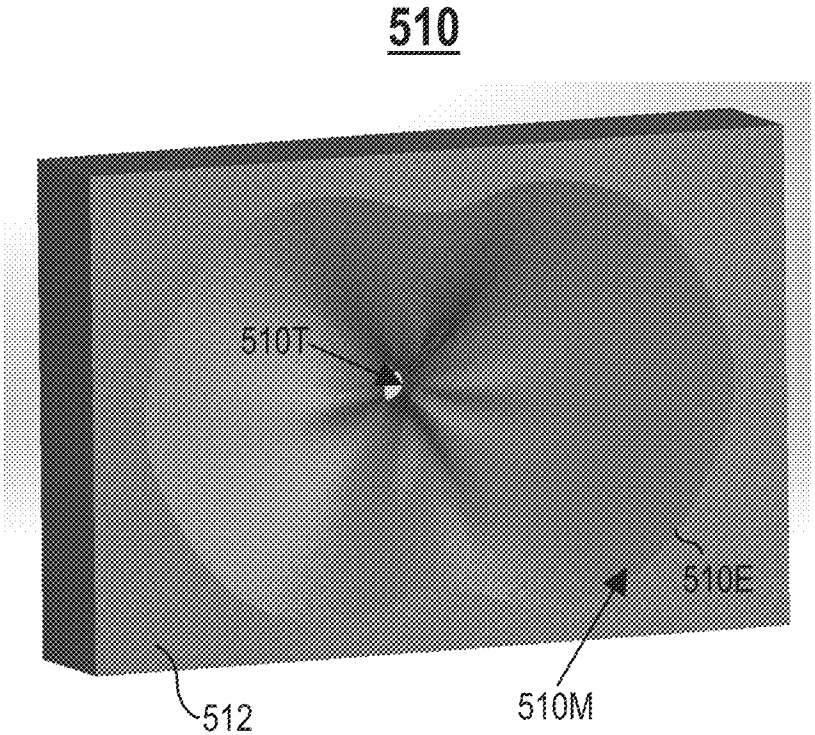
FIG. 12A illustrates another example waveguide with a non-tangential throat and a non-tangential mouth, in accordance with one embodiment.

In alternative embodiments, waveguides for the loudspeaker device 10 have non-tangential throats and/or mouths. FIG. 12A illustrates another example waveguide 510 with a non-tangential throat 510T and a non-tangential mouth 510M, in accordance with one embodiment. FIG. 12B illustrates a cross sectional view of the waveguide 510 in FIG. 12A with the non-tangential mouth 510M, in accordance with one embodiment. FIG. 12C illustrates a cross sectional view of the waveguide 510 in FIG. 12A with the non-tangential throat 510T, in accordance with one embodiment. Unlike the waveguide 100 in FIG. 3A, the mouth 510M of the waveguide 510 does not smoothly and continuously transition to a top plane/plate/surface 512; instead, a mouth exit/termination 510E of the mouth 510M is defined by a sharp transition. As shown in FIG. 12B, a non-tangential connection 511M is formed between the mouth 510M and the top plane/plate/surface 512.

Unlike the waveguide 100 in FIGS. 3A-3F, the throat 510T does not smoothly and continuously transition from an exit 55E of a speaker driver 55; instead, a beginning/start of the throat 510T is defined by a sharp transition. As shown in FIG. 12C, a non-tangential connection 511T is formed between the throat 510T and the exit 55E of the speaker driver 55.

Figure 13:
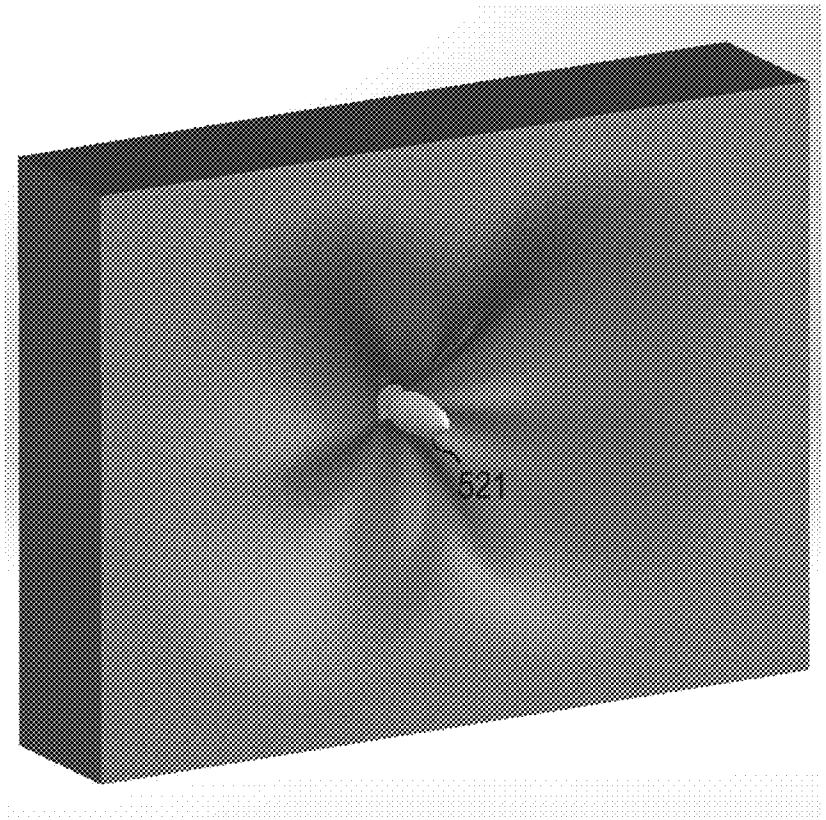
FIG. 13 illustrates another example waveguide with a phase plug 521, in accordance with one embodiment.

In alternative embodiments, waveguides for the loudspeaker device 10 include phase plugs. FIG. 13 illustrates another example waveguide 520 with a phase plug 521, in accordance with one embodiment. The phase plug 521 is positioned at a center of the waveguide 520 and in front of an exit of a speaker driver 55. For a speaker driver 55 having an exit with a larger diameter, adding the phase plug 521 provides additional sound directivity control of sound waves at the highest frequencies.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of pre-AIA 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A loudspeaker device comprising: a speaker driver; and a waveguide positioned in front of the speaker driver, wherein the waveguide comprises:

one or more ridge areas; one or more recess areas; and one or more smooth surfaces, wherein each smooth surface connects a ridge area to a recess area to create a smooth and seamless transition between the ridge area and the recess area without any sharp transitions;

wherein the one or more ridge areas protrude radially outward relative to the one or more recess areas and the one or more smooth surfaces, and each ridge area is narrower than each recess area; and wherein the one or more ridge areas, the one or more recess areas, and the one or more smooth surfaces together form a shape of the waveguide, the shape of the waveguide is corner-free or edge-free between opposite ends of the waveguide, and the waveguide shapes propagation of high frequency sound waves generated by the speaker driver to provide a smooth off-axis frequency response for the sound waves.

2. The loudspeaker device of claim 1, wherein the speaker driver is one of a high frequency speaker driver or a compression driver.

3. The loudspeaker device of claim 1, wherein the smooth off-axis frequency response exhibits smooth and monotonous decay with higher frequencies of sound waves generated by the speaker driver, resulting in a smooth change of timbre as listening positions change.

4. The loudspeaker device of claim 1, wherein the one or more ridge areas extend in a radial direction.

5. The loudspeaker device of claim 4, wherein the radial direction of the one or more ridge areas controls beamwidth of the sound waves by dispersing the sound waves to a wider beam, resulting in a wide coverage angle.

6. The loudspeaker device of claim 1, wherein the one or more ridge areas control sound directivity of the sound waves in horizontal and vertical planes within a spatial area.

7. The loudspeaker device of claim 1, wherein the one or more recess areas are arranged to form smooth clover-like transitions that provide a wide coverage angle for the sound waves and the smooth off-axis frequency response.

8. The loudspeaker device of claim 1, wherein the waveguide has four ridge areas and four recess areas in total.

9. The loudspeaker device of claim 1, wherein the shape of the waveguide is based on one or more cross sectional profiles defined by one or more cubic Bezier curves.

10. The loudspeaker device of claim 9, wherein the shape of the waveguide is optimized by simultaneously optimizing horizontal directivity and vertical directivity of the waveguide.

11. The loudspeaker device of claim 1, wherein the one or more ridge areas protrude beyond a baffle that the waveguide is mounted on.

12. The loudspeaker device of claim 1, wherein at least one of a throat and a mouth of the waveguide is tangential.

13. The loudspeaker device of claim 1, wherein at least one of a throat and a mouth of the waveguide is non-tangential.

14. The loudspeaker device of claim 1, wherein the waveguide further comprises a phase plug positioned at a center of the waveguide and in front of the speaker driver.

15. A waveguide for controlling sound directivity of high frequency sound waves generated by a speaker driver, comprising: one or more ridge areas; one or more recess areas; and one or more smooth surfaces, wherein each smooth surface connects a ridge area to a recess area to create a smooth and seamless transition between the ridge area and the recess area without any sharp transitions;

wherein the one or more ridge areas protrude radially outward relative to the one or more recess areas and the one or more smooth surfaces, and each ridge area is narrower than each recess area; and wherein the one or more ridge areas, the one or more recess areas, and the one or more smooth surfaces together form a shape of the waveguide, the shape of the waveguide is corner-free or edge-free between opposite ends of the waveguide, the waveguide is positioned in front of the speaker driver, and the waveguide shapes propagation of the sound waves to provide a smooth off-axis frequency response for the sound waves.

16. The waveguide of claim 15, wherein the one or more ridge areas extend in a radial direction, and the radial direction of the one or more ridge areas controls beamwidth of the sound waves by dispersing the sound waves to a wider beam, resulting in a wide coverage angle.

17. The waveguide of claim 15, wherein the one or more recess areas are arranged to form smooth clover-like transitions that provide a wide coverage angle for the sound waves and the smooth off-axis frequency response.

18. The waveguide of claim 15, wherein the shape of the waveguide is based on one or more cross sectional profiles defined by one or more cubic Bezier curves, and the shape of the waveguide is optimized by simultaneously optimizing horizontal directivity and vertical directivity of the waveguide.

19. The waveguide of claim 15, wherein the one or more ridge areas protrude beyond a baffle that the waveguide is mounted on.

20. The waveguide of claim 15, wherein the waveguide further comprises a phase plug positioned at a center of the waveguide and in front of the speaker driver.

* * * * *